US006688056B2

(12) United States Patent
Von Hoyningen Huene et al.

(10) Patent No.: US 6,688,056 B2
(45) Date of Patent: Feb. 10, 2004

(54) MOVEABLE AND DEMOUNTABLE WALL PANEL SYSTEM

(75) Inventors: Eberhard Von Hoyningen Huene, Hudson (CA); Michael Salzman, Dollard-des-Ormeaux (CA); Geoffrey Boyer, Pointe-Claire (CA)

(73) Assignee: Eberhard von Huene & Associates, Quebec (CA)

( * ) Notice: Subject to any disclaimer, the term of this patent is extended or adjusted under 35 U.S.C. 154(b) by 0 days.

(21) Appl. No.: 10/027,872

(22) Filed: Dec. 21, 2001

(65) Prior Publication Data

US 2002/0121056 A1 Sep. 5, 2002

(30) Foreign Application Priority Data

Dec. 22, 2000 (CA) ..... 2329591

(51) Int. Cl.[7] ..... E04H 6/00
(52) U.S. Cl. ..... 52/243.1; 52/238.1
(58) Field of Search ..... 52/243.1, 238.1, 52/468, 469, 511, 126.1, 220.7, 290, 481.2

(56) References Cited

U.S. PATENT DOCUMENTS

| | | | | | |
|---|---|---|---|---|---|
| 2,387,389 | A | * | 10/1945 | Goldsmith | 52/290 |
| 2,394,443 | A | * | 2/1946 | Guignon | 52/580 |
| 2,822,898 | A | * | 2/1958 | Richards | 52/471 |
| 3,040,847 | A | | 6/1962 | Webster | |
| 3,057,444 | A | * | 10/1962 | Walberg | 52/461 |
| 3,228,160 | A | * | 1/1966 | O'Brien | 52/242 |
| 3,302,353 | A | * | 2/1967 | Pradal | 52/469 |
| 3,352,078 | A | | 11/1967 | Neal | |
| 3,363,383 | A | | 1/1968 | La Barge | |
| 3,381,436 | A | * | 5/1968 | Elliot | 52/468 |
| 3,411,252 | A | * | 11/1968 | Boyle | 52/126.4 |
| 3,585,768 | A | * | 6/1971 | Klein | 52/731.3 |
| 3,675,382 | A | | 7/1972 | Lickliter et al. | |

(List continued on next page.)

FOREIGN PATENT DOCUMENTS

| | | |
|---|---|---|
| CA | 2 002 674 | 3/1993 |
| FR | 1 450 017 | 11/1966 |
| FR | 1 526 637 | 5/1968 |

*Primary Examiner*—Carl D. Friedman
*Assistant Examiner*—Kevin McDermott
(74) *Attorney, Agent, or Firm*—Merchant & Gould P.C.

(57) ABSTRACT

A moveable and demountable wall panel system including a plurality of panels each having opposite top and bottom distance channels, opposite left and right vertical posts, a panel covering, a ceiling rail, and an articulating floor channel. The distance channels and vertical posts are affixed to one another by connecting studs in order to form a rectangular support frame of the panel. The articulating floor channel is operatively connected to a bottom portion of the rectangular support frame by left and right glide assemblies mounted into receiving channels of the left and right vertical posts respectively. The articulating floor channel is used for operatively securing the rectangular support frame of the panel to a ground surface. Each vertical post has at least one receiving lip extending along a direction substantially parallel to the vertical axis of the panel.

19 Claims, 60 Drawing Sheets

U.S. PATENT DOCUMENTS 3,697,028 A * 10/1972 Nimmo ..... 248/121
3,722,026 A * 3/1973 Wilhelmi ..... 16/42 T
4,027,714 A * 6/1977 Dixon et al. ..... 160/84.08
4,086,734 A * 5/1978 Hayashi ..... 52/126.4
4,167,084 A 9/1979 Brunton
4,399,644 A 8/1983 Bright
4,625,476 A * 12/1986 Shimada ..... 52/126.4
4,640,072 A 2/1987 Mühle
4,703,598 A * 11/1987 Wilson et al. ..... 52/238.1
4,757,657 A 7/1988 Mitchell et al.
4,825,610 A 5/1989 Gasteiger
4,914,880 A * 4/1990 Albertini ..... 52/243
5,056,577 A 10/1991 DeLong et al.
5,125,201 A * 6/1992 Pieters et al. ..... 52/238.1
5,159,793 A 11/1992 Deugo et al.
5,207,037 A 5/1993 Giles et al.
5,379,560 A 1/1995 Steller
5,381,845 A 1/1995 Ruggie et al.
5,491,943 A 2/1996 Vondrejs et al.
5,603,192 A * 2/1997 Dickson ..... 52/238.1
5,644,878 A 7/1997 Wehrmann
5,735,089 A 4/1998 Smith et al.
5,875,596 A 3/1999 Muller
5,881,979 A * 3/1999 Rozier et al. ..... 248/188.5
5,996,299 A * 12/1999 Hsueh ..... 52/481.2
6,047,508 A * 4/2000 Goodman et al. ..... 52/241
6,088,877 A * 7/2000 Swy et al. ..... 16/42 T
6,112,485 A 9/2000 Beyer et al.
6,122,871 A 9/2000 Russell et al.
6,170,213 B1 * 1/2001 Zarrelli et al. ..... 52/509
6,176,054 B1 * 1/2001 Allen et al. ..... 52/272
6,209,610 B1 * 4/2001 Davies et al. ..... 160/26
6,329,591 B2 * 12/2001 Karst et al. ..... 174/48
6,349,516 B1 * 2/2002 Powell et al. ..... 52/239
6,405,781 B2 * 6/2002 Davies et al. ..... 160/23.1
6,493,995 B2 * 12/2002 McKenzie ..... 52/36.4
2002/0088188 A1 * 7/2002 Chang ..... 52/238.1
2002/0157335 A1 * 10/2002 Vos ..... 52/238.1

* cited by examiner

MOVEABLE AND DEMOUNTABLE WALL PANEL SYSTEM

FIELD OF THE INVENTION

The present invention relates to a wall panel system. More particularly, the present invention relates to a moveable non-progressive mountable and demountable wall panel system.

BACKGROUND OF THE INVENTION

Fixed wall systems, moveable wall systems, and non-progressive wall systems are very well known in the art.

Some problems associated with fixed wall systems are the inability to displace and/or move the fixed wall systems once they are mounted; the inability to readily install passthrough components (wiring, etc.) after the fixed wall systems have been mounted; and the inability to readily change aspects and features of the fixed wall systems once they are installed. Furthermore, fixed wall systems are also disadvantageous because their installing is quite lengthy. For example, for conventional gyproc walls, one must first install supporting studs, then affix gyproc panels thereto, then plaster thereon, wait for drying of the plaster, sanding subsequently and then finishing the surfaces of the gyproc walls. It is well known in the art that the mounting of such fixed wall systems usually extends over several days and requires a great deal of manual labour, which is thus very inefficient and very cost ineffective.

Some of the problems associated with moveable wall systems are that, very often, their components are over-engineered (e.g. too heavy), different and specialized tooling is required for assembling such moveable wall systems, and the moveable wall systems generally comprise various different components which are not readily interchangeable. As a results of the above-mentioned, installation of such moveable wall systems is generally quite lengthy and cumbersome. Furthermore, it is well known in the art that such moveable wall systems, by virtue of their design, offer generally very poor sound proofing, light proofing and/or vibration proofing.

Some of the problems associated with non-progressive wall systems are the inability to independently change, move, and/or alter a particular component of the non-progressive wall system without affecting the other components operatively connected to said particular component. Indeed, by virtue of their design, non-progressive wall systems generally have several components which are intricately connected to one another and thus prevent one particular component thereof from being changed, moved, and/or altered without disturbing the other components of the non-progressive wall system.

Known to the Applicant are the following American patents which describe different wall panel systems: U.S. Pat. Nos. 3,040,847; 3,352,078; 3,363,383; 3,675,382; 4,167,084; 4,399,644; 4,640,072; 4,757,657; 4,825,610; 5,056,577; 5,159,793; 5,207,037; 5,379,560; 5,381,845; 5,491,943; 5,644,878; 5,735,089; 5,875,596; 6,112,485; and 6,122,871.

None of the above-mentioned patents seem to disclose or even suggest a movable non-progressive mountable and demountable wall panel system which would overcome several of the above-mentioned problems associated with the prior art.

SUMMARY OF THE INVENTION

An object of the present invention is to provide a wall panel system which would satisfy some of the above-mentioned needs, and would thus be an improvement over the wall panel systems known in the art.

In accordance with the present invention, the above object is achieved by a moveable and demountable wall panel system comprising a plurality of panels used for defining an office space, each panel having a vertical axis and a horizontal axis, each panel comprising:

- opposite top and bottom distance channels, the distance channels extending along directions substantially parallel to the horizontal axis of the panel;
- opposite left and right vertical posts, the vertical posts extending along directions substantially parallel to the vertical axis of the panel, the distance channels and vertical posts being affixed to one another by means of connecting studs for forming a rectangular support frame of the panel;
- a panel covering removably mountable onto receiving means of the rectangular support frame;
- a ceiling rail operatively connected to a top portion of the rectangular support frame, the ceiling rail being used for operatively securing the rectangular support frame of the panel to a ceiling surface; and
- an articulating floor channel operatively connected to a bottom portion of the rectangular support frame by means of left and right glide assemblies mounted into receiving channels of the left and right vertical posts respectively, the articulating floor channel being used for operatively securing the rectangular support frame of the panel to a ground surface, the glide assemblies being further used for displacing the rectangular support frame with respect to the floor channel along a direction substantially parallel to the vertical axis of the panel;
- wherein each vertical post comprises at least one receiving lip extending along a direction substantially parallel to the vertical axis of the panel, each receiving lip being removably connectable to another receiving lip of a vertical post of a neighboring panel by means of a connector for selectively and removably connecting together a plurality of panels in order to define said office space.

Preferably, the receiving means comprise receiving grooves disposed along the vertical posts in a direction substantially parallel to the vertical axis of the panel and the panel covering comprises an outer panel shell and vertical stiffeners, the vertical stiffeners being securely affixed to lateral sides of the outer panel shell of the panel covering and being removably connectable onto the receiving grooves of the vertical posts for removably connecting the panel covering onto the rectangular support frame of the panel.

Preferably, the receiving means comprise a receiving groove disposed along the top distance channel in a direction substantially parallel to the horizontal axis of the panel and the panel covering comprises an outer panel shell and a top stiffener, the top stiffener being securely affixed to a lateral side of the outer panel shell of the panel covering and being removably hookable onto the receiving groove of the top distance channel for removably hooking the panel covering onto the rectangular support frame of the panel.

Preferably, the vertical stiffeners each comprise a bracket and a flexible clip securely affixed onto one another, the brackets being further securely affixed to the lateral sides of the outer panel shell of the panel covering and the flexible clips being removably connectable into the receiving grooves of the vertical posts.

Preferably, the panel covering comprises an outer panel shell and intermediate stiffeners, the intermediate stiffeners being securely affixed transversely onto the outer panel shell of the panel covering in a direction substantially parallel to the horizontal axis of the panel.

Preferably, the connectors may comprise fins, may comprise flexible skirts, and may be provided with covering caps.

Preferably, floor channel is securely affixed to the ground surface by means of fasteners, and the ceiling rail is securely affixed to the ceiling surface by means of fasteners.

Preferably, each glide assembly comprises a substantially L-shaped glide and a glide bolt. The substantially L-shaped glide preferably has an abutment flange and an insert, the insert being removably insertable into a receiving channel of a corresponding vertical post. Preferably also, the glide bolt is threadedly mounted into the abutment flange of the glide and has a pivot head articulately mounted to the floor channel by means of a rivet.

Preferably also, the pivot head of the glide bolt is positioned inside a longitudinal groove of the floor channel, and the rivet of the pivot head is constrained to slide along a transversal slot of the longitudinal groove of the floor channel. The insert of the glide preferably comprises two tongues removably mountable into respective receiving channels of a corresponding vertical post.

The invention and its advantages would be better understood upon reading the following non-restrictive description of preferred embodiments thereof, made with reference to the accompanying drawings.

DETAILED DESCRIPTION OF PREFERRED EMBODIMENTS OF THE INVENTION

Figure 1:
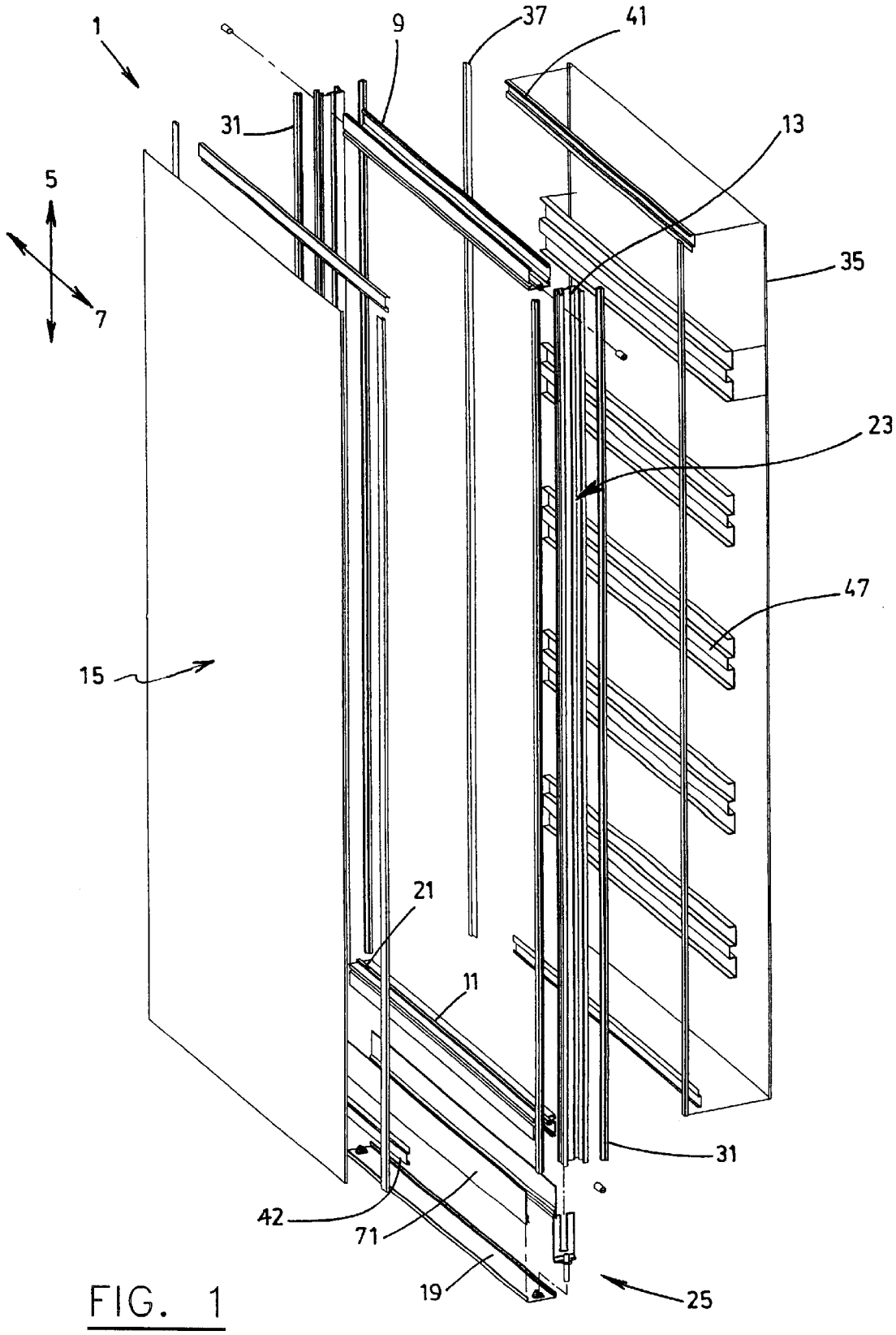
FIG. 1 is an exploded perspective view of a solid wall panel according to a preferred embodiment of the invention.

In the following description, the same numerical references refer to similar elements. The embodiments shown in the figures are preferred only.

Moreover, although the present invention as exemplified hereinafter was primarily designed for wall systems, it could be used with other objects and for other purposes, such as with furniture applications, for example, as apparent to a person skilled in the art. For this reason, expressions such as "wall" and any other references and/or other expressions equivalent thereto should not be taken as to limit the scope of the present invention and include all other objects and all other applications with which the present invention could be used and may be useful.

Similarly, expressions such as "wall" and "panel", as well as any mutually equivalent expressions and/or compound words thereof, may be used interchangeably in the context of the present description. The same applies for any other mutually equivalent expressions, such as "covering" and "shell" and "screw" and "bolt" for example, as also apparent to a person skilled in the art.

In addition, although the preferred embodiment of the wall panel system 1 as disclosed hereinafter comprises various components such as intermediate stiffeners 47, gaskets, connecting studs 21, transition channels 9, 11, glide assemblies 25, solid panels 3, glass panels 3, stackable flyovers 81, etc., which are useful and present several substantial advantages, not all of these components are essential to the invention and thus should not be taken in their restrictive sense, i.e. should not be taken as to limit the scope of the present invention. It is to be understood, as also apparent to a person skilled in the art, that other suitable components and cooperations thereinbetween may be used for the wall panel system 1 according to the present invention, as will be explained hereinafter, without departing from the scope of the invention.

Broadly described, the wall panel system 1 according to the preferred embodiment of the invention as it is illustrated in the accompanying drawings, is a wall panel system 1 comprising a plurality of panels 3 used for defining an office space. Each panel 3 has a vertical axis 5 and a horizontal axis 7. Each panel 3 has opposite top and bottom distance channels 9, 11, opposite left and right vertical posts 13, a panel covering 15, a ceiling rail 17, and an articulating floor channel 19. The top and bottom distance channels 9, 11 extend along a direction substantially parallel to the horizontal axis 7 of the panel 3. The left and right vertical posts 13 extend along a direction substantially parallel to the vertical axis 5 of the panel 3. The distance channels 9, 11 and vertical posts 13 are affixed to one another by means of connecting studs 21 so as to form a rectangular support frame 23 of the panel 3. The panel covering 15 is removably mountable onto receiving means of the rectangular support frame 23. The ceiling rail 17 is operatively connected to a top portion of the rectangular support frame 23 and is used for operatively securing the rectangular support frame 23 of the panel 3 to a ceiling surface. The articulating floor channel 19 is operatively connected to a bottom portion of the rectangular support frame 23 by means of left and right glide assemblies 25 mounted into receiving channels 27 of the left and right vertical posts 13 respectively. The articulating floor channel 19 is used for operatively securing the rectangular support frame 23 of the panel 3 to a ground surface. The glide assemblies 25 are also used for displacing the rectangular support frame 23 with respect to the floor channel 19 along a direction substantially parallel to the vertical axis 5 of the panel 3. Each vertical post 13 has at least one receiving lip 29 extending along a direction substantially parallel to the vertical axis 5 of the panel 3. Each receiving lip 29 is removable connectable to another receiving lip 29 of a vertical post 13 of a neighboring panel 3 by means of a connector 31 for selectively and removably connecting together a plurality of panels 3 in order to define the office space. By virtue of its design and its components, the present wall panel system 1 is a moveable non-progressive mountable and demountable wall panel system 1.

Preferably, the receiving means comprise receiving grooves 33 disposed along the vertical posts 13 in a direction substantially parallel to the vertical axis 5 of the panel 3 and the panel covering 15 comprises an outer panel shell 35 and vertical stiffeners 37, the vertical stiffeners 37 being securely affixed to lateral sides of the outer panel shell 35 of the panel covering 15 and being removably connectable onto the receiving grooves 33 of the vertical posts 13 for removably connecting the panel covering 15 onto the rectangular support frame 23 of the panel 3, as better shown in FIGS. 1, 3, 4, 7 and 12.

Preferably, the receiving means comprise a receiving groove 39 disposed along the top distance channel 9 in a direction substantially parallel to the horizontal axis 7 of the panel 3 and the panel covering 15 comprises an outer panel shell 35 and a top stiffener 41, the top stiffener 41 being securely affixed to a lateral side of the outer panel shell 35 of the panel covering 15 and being removably hookable onto the receiving groove 39 of the top distance channel 9 for removably hooking the panel covering 15 onto the rectangular support frame 23 of the panel 3, as better shown in FIGS. 1, 3, 4, and 7.

Figure 25:
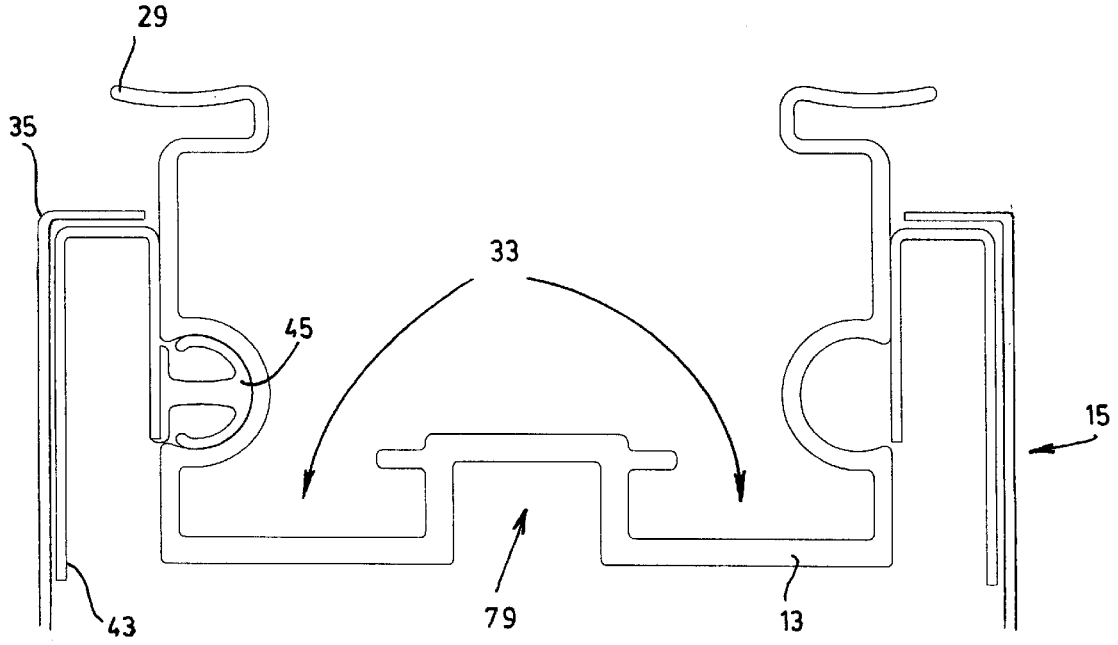
FIG. 25 is a partial sectional view of two panel coverings 15 mounted onto a vertical post by means of a vertical stiffener according to a preferred embodiment of the invention.
Figure 26:
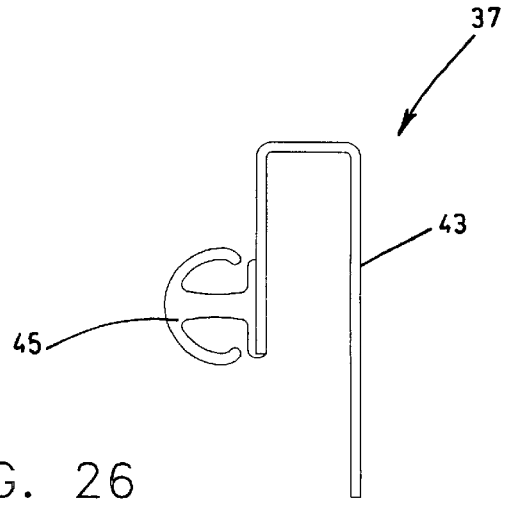
FIG. 26 is a cross-sectional view of one of the vertical stiffeners shown in FIG. 25.
Figure 27:
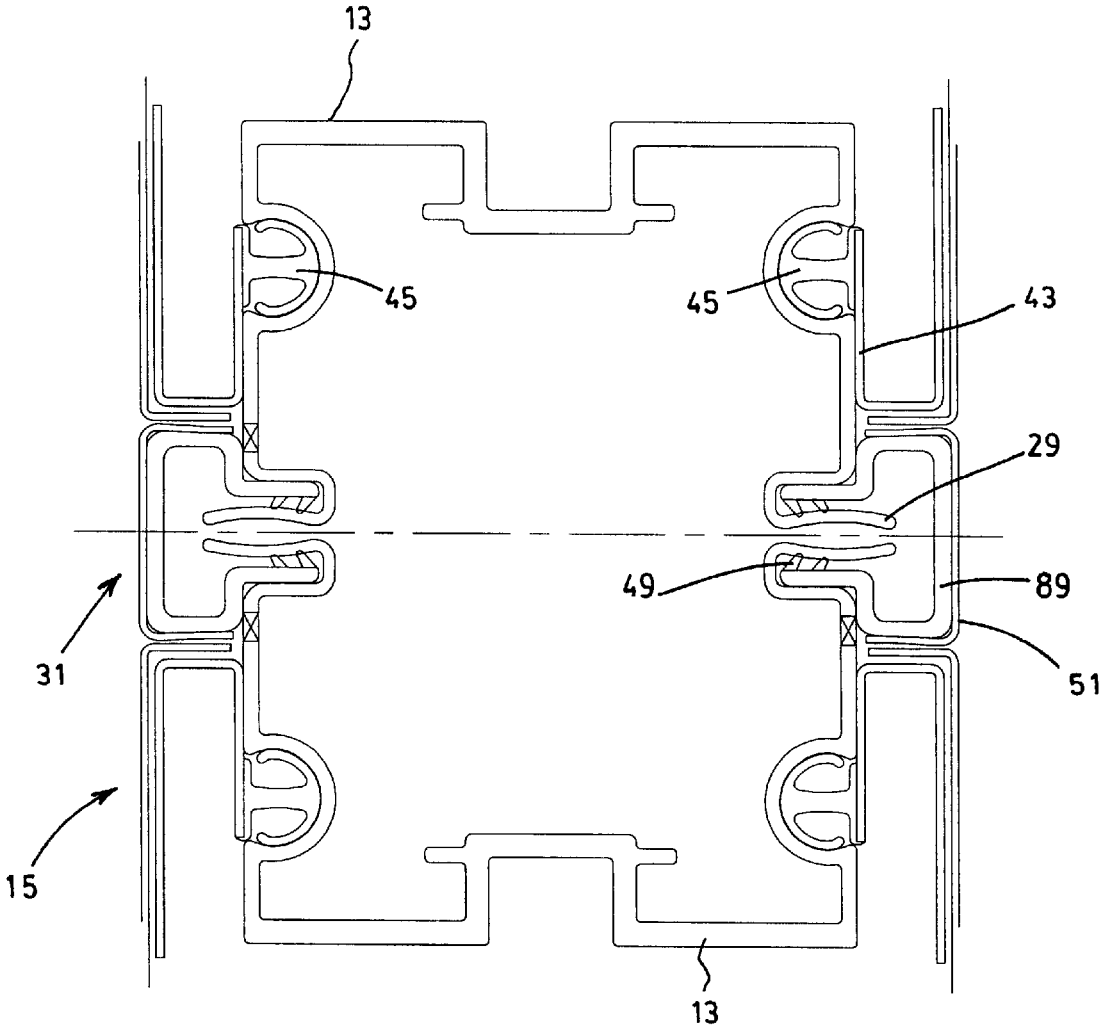
FIG. 27 is a wall panel assembly according to a preferred embodiment of the invention.

Preferably, the vertical stiffeners 37 each comprise a bracket 43 and a flexible clip 45 securely affixed onto one another, the brackets 43 being further securely affixed to the lateral sides of the outer panel shell 35 of the panel covering 15 and the flexible clips 45 being removably connectable into the receiving grooves 33 of the vertical posts 13, as better shown in FIGS. 25–27.

Figure 3:
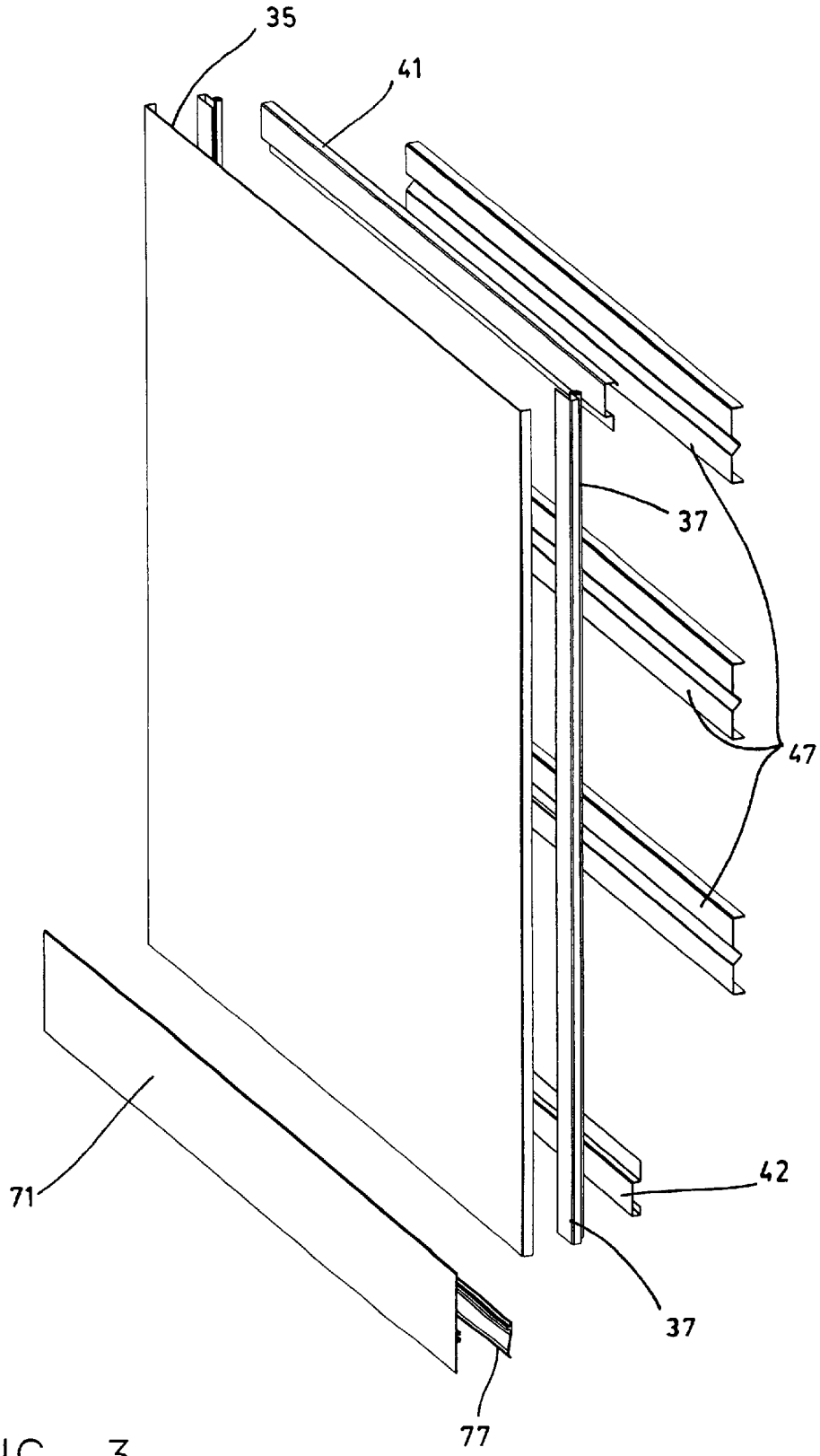
FIG. 3 is an exploded perspective view of some of the components of the wall panel shown in FIG. 1, said wall panel being shown in an exploded view with a base cover according to a preferred embodiment of the invention.
Figure 4:
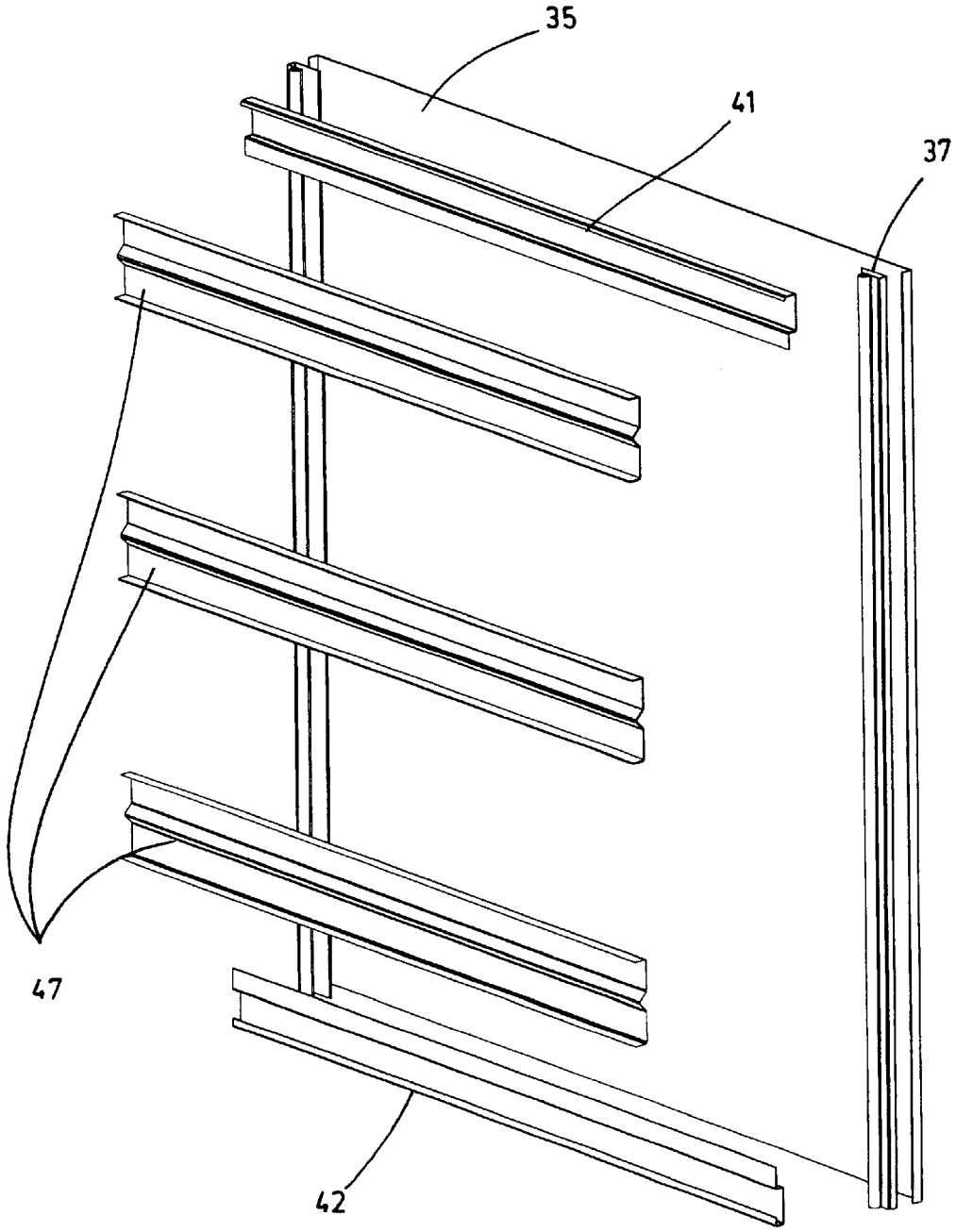
FIG. 4 is another exploded perspective view of what is shown in FIG. 4.
Figure 5:
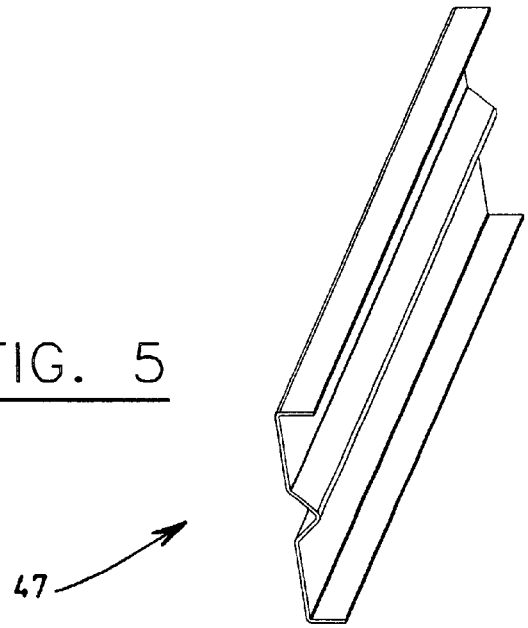
FIG. 5 is a perspective view of an intermediate stiffener of the wall panel shown in FIG. 1.
Figure 6:
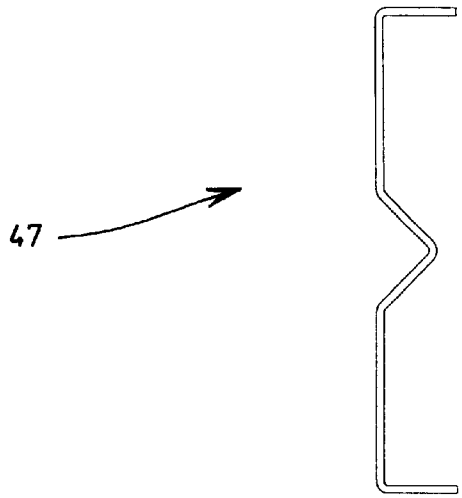
FIG. 6 is a cross-sectional view of the intermediate stiffener shown in FIG. 5.

Preferably, the panel covering 15 comprises an outer panel shell 35 and intermediate stiffeners 47, the intermediate stiffeners 47 being securely affixed transversely onto the outer panel shell 35 of the panel covering 15 in a direction substantially parallel to the horizontal axis 7 of the panel 3, as better shown in FIGS. 1, 3 and 4.

Preferably, the connectors 31 may comprise fins 49, may comprise flexible skirts 50, and may be provided with covering caps 51, as better shown in FIGS. 7 and 27–35. The connectors 31 are preferably shaped and sized to provide proper sound proofing, light proofing and vibration proofing to the wall panel system 1.

Figure 21:
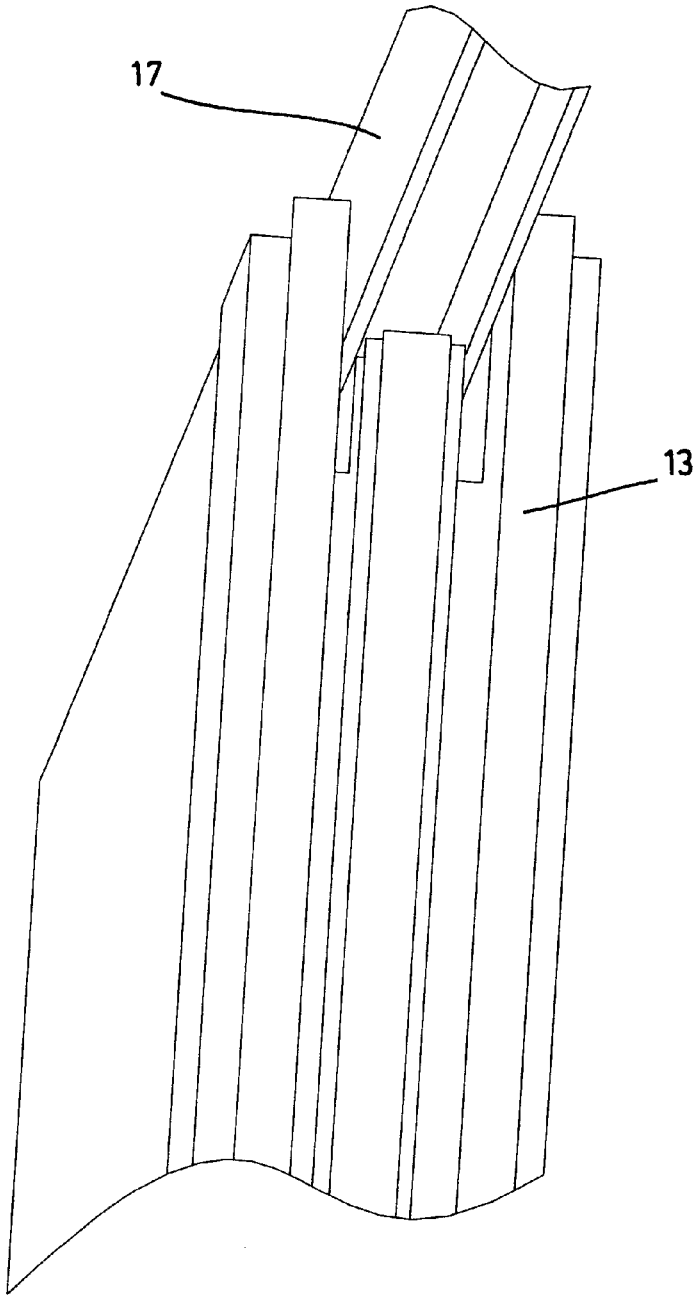
FIG. 21 is a perspective view of a ceiling rail cooperating with a notched vertical post according to a preferred embodiment of the invention.
Figure 22:
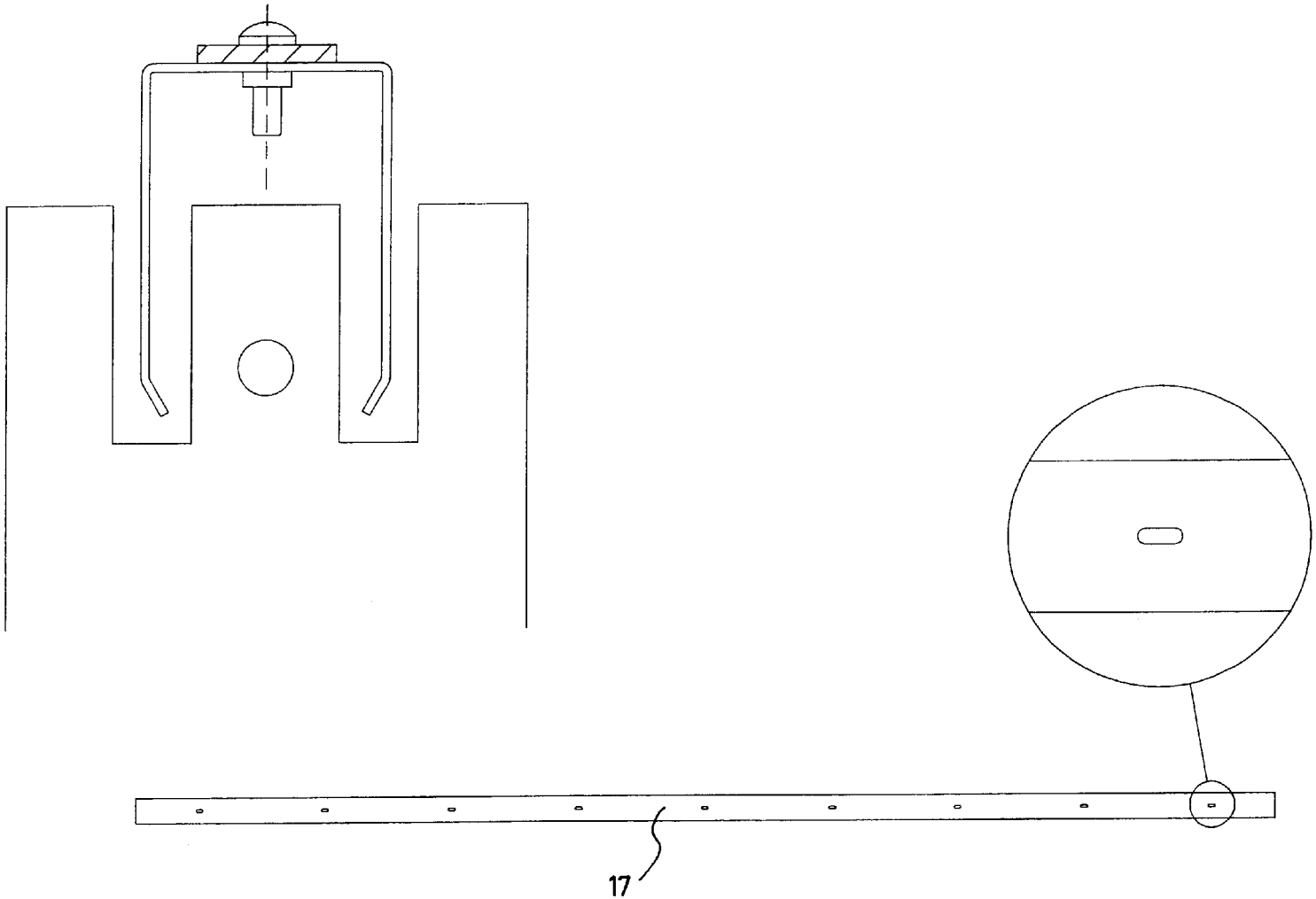
FIG. 22 is a top plan view of the ceiling rail shown in FIG. 21.

Preferably, the floor channel 19 is securely affixed to the ground surface by means of fasteners, and the ceiling rail 17 is securely affixed to the ceiling surface by means of fasteners, as better shown in FIGS. 21 and 22.

Preferably, each glide assembly 25 comprises a substantially L-shaped glide 53 and a glide bolt 55. The substantially L-shaped glide 53 preferably has an abutment flange 57 and an insert 59, the insert 59 being removably insertable into a receiving channel 27 of a corresponding vertical post 13. Preferably also, the glide bolt 55 is threadedly mounted into the abutment flange 57 of the glide 53 and has a pivot head 61 articulately mounted to the floor channel 19 by means of a rivet 63, as better shown in FIGS. 10–12 and 23.

Figure 11:
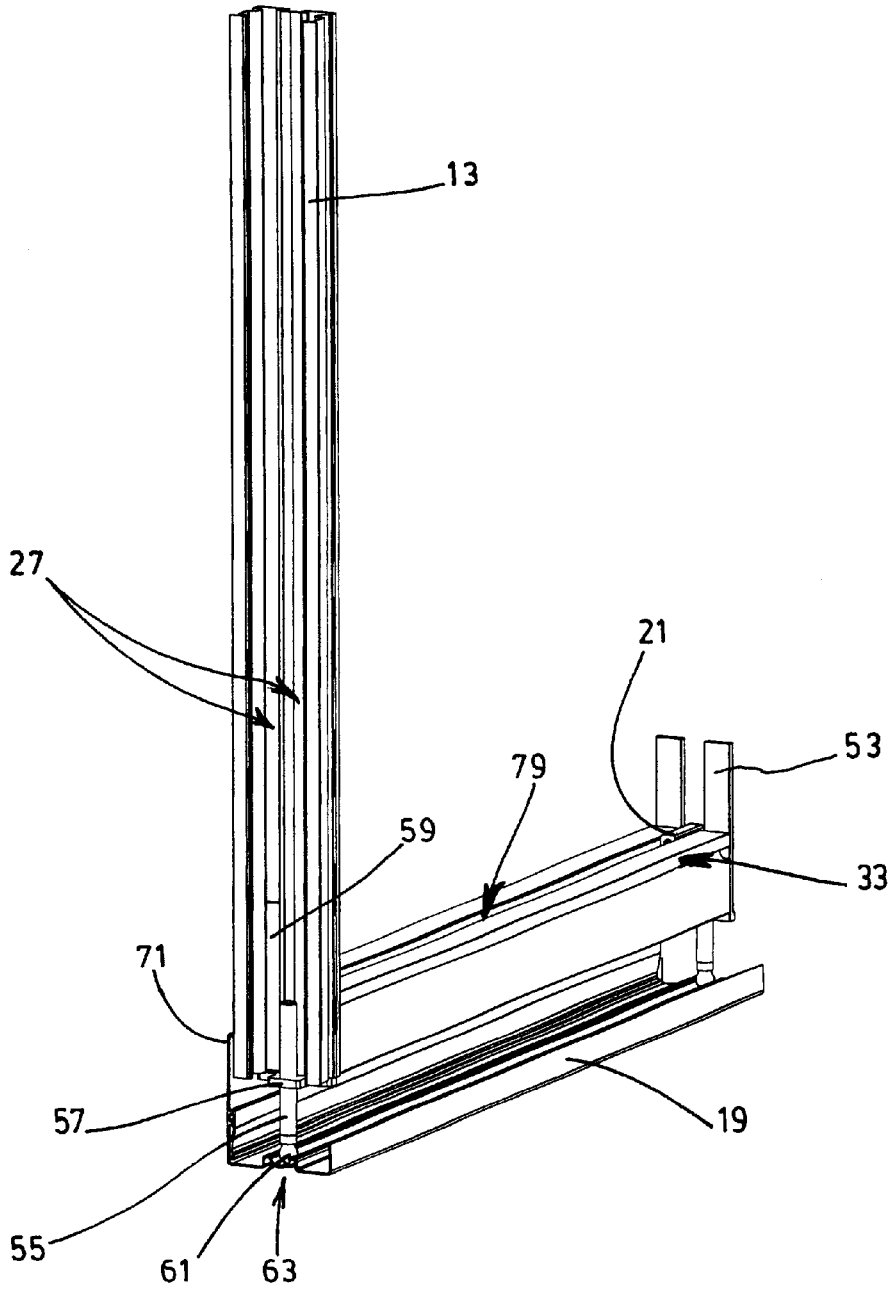
FIG. 11 is another perspective view of what is shown in FIG. 10.
Figure 12:
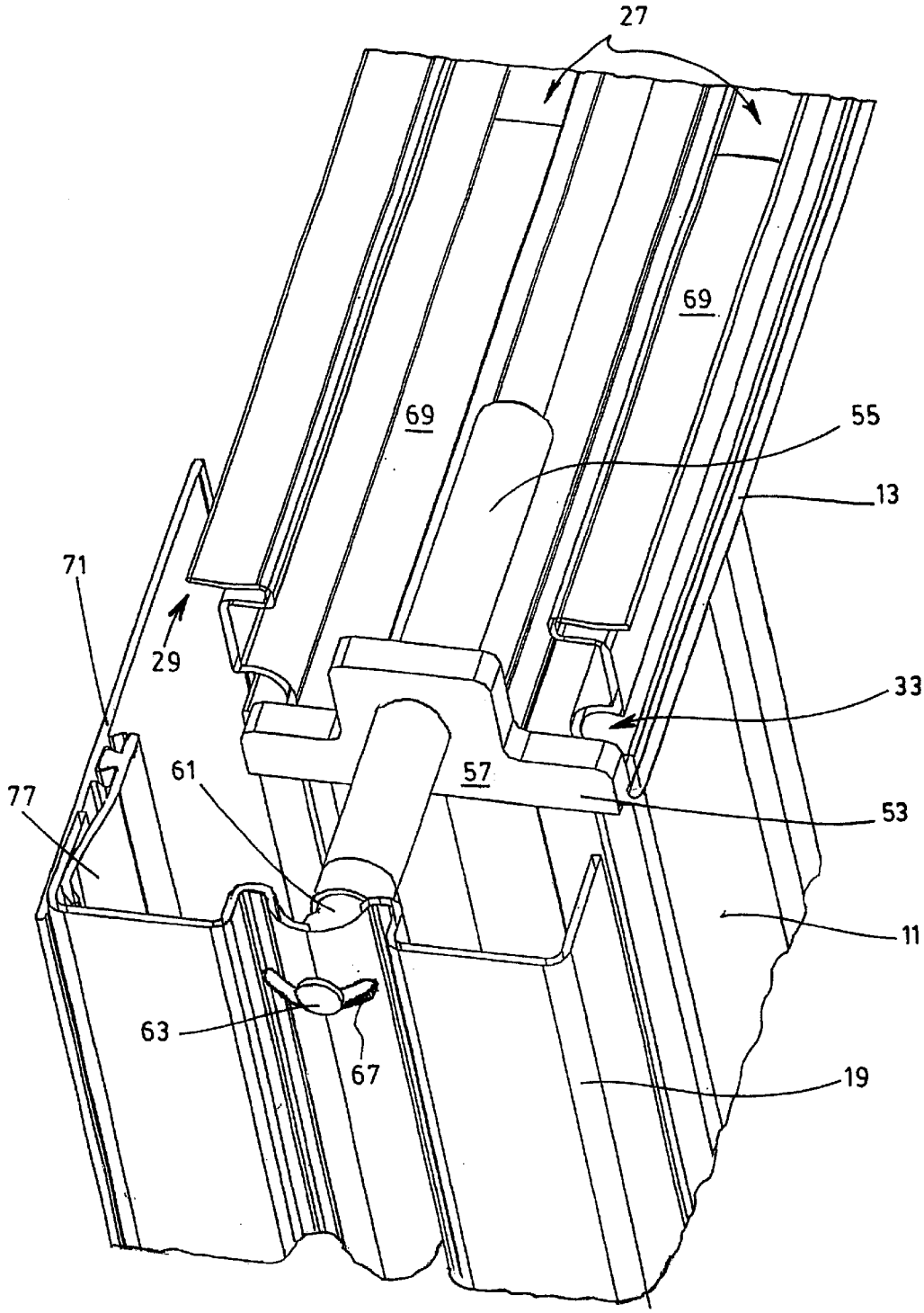
FIG. 12 is yet another perspective view of what is shown in FIG. 10.
Figure 24:
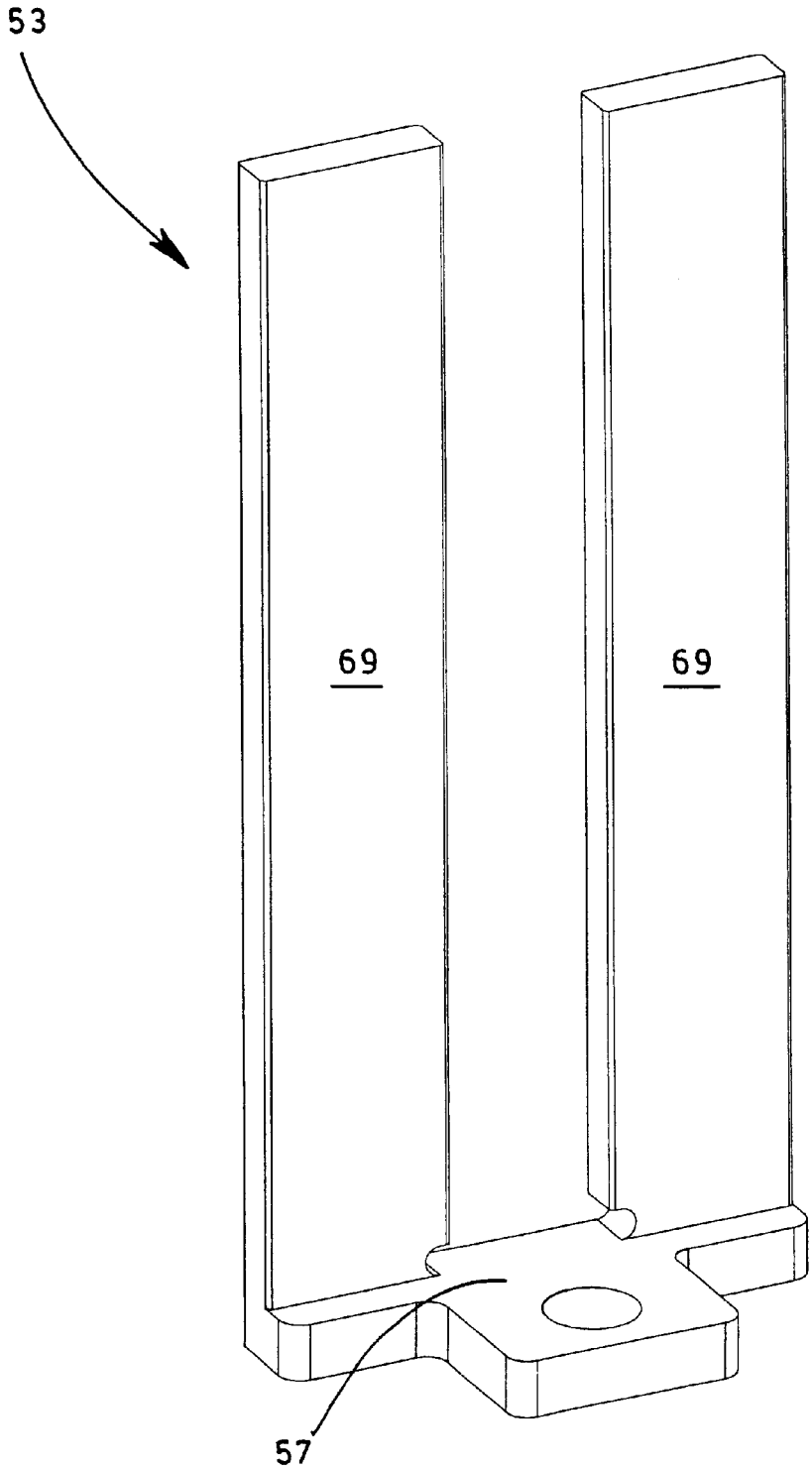
FIG. 24 is a perspective view of the glide of the glide assembly shown in FIG. 23.

Preferably also, the pivot head 61 of the glide bolt 55 is positioned inside a longitudinal groove 65 of the floor channel 19, and the rivet 63 of the pivot head 61 is constrained to slide along a transversal slot 67 of the longitudinal groove 65 of the floor channel 19, as better shown in FIG. 12. The insert 59 of the glide 53 preferably comprises two tongues 69 removably mountable into respective receiving channels 27 of a corresponding vertical post 13, as better shown in FIGS. 11, 12 and 24.

Preferably, the wall panel system 1 further comprises a base cover 71 and the base cover 71 preferably comprises a base cover insert 73 for removably mounting the base cover 71 onto the floor channel 19 of the panel 3, as better shown in FIGS. 3, 10–12, and 23.

Preferably also, at least two connecting studs 21 are respectively and securely affixed at opposite ends of each of the top and bottom distance channels 9, 11, as better shown in FIGS. 1, 2, 10, 11, 15 and 16.

Preferably, each distance channel 9, 11 and each vertical post 13 comprise at least one interseptum 79, so that accessories of the panel system 1 can be removably mounted onto said intersepta 79, as shown in several of the accompanying drawings.

Preferably, each panel 3 is stackable onto another panel 3 by means of stackable flyovers 81 inserted and fastened into the receiving channels 27 of the vertical posts 13 of the stacked panels 3, as better shown in FIGS. 13, 14, 17 and 18. Preferably also, the stackable flyovers 81 comprise interference ribs 83, as better shown in FIG. 19.

Figure 20:
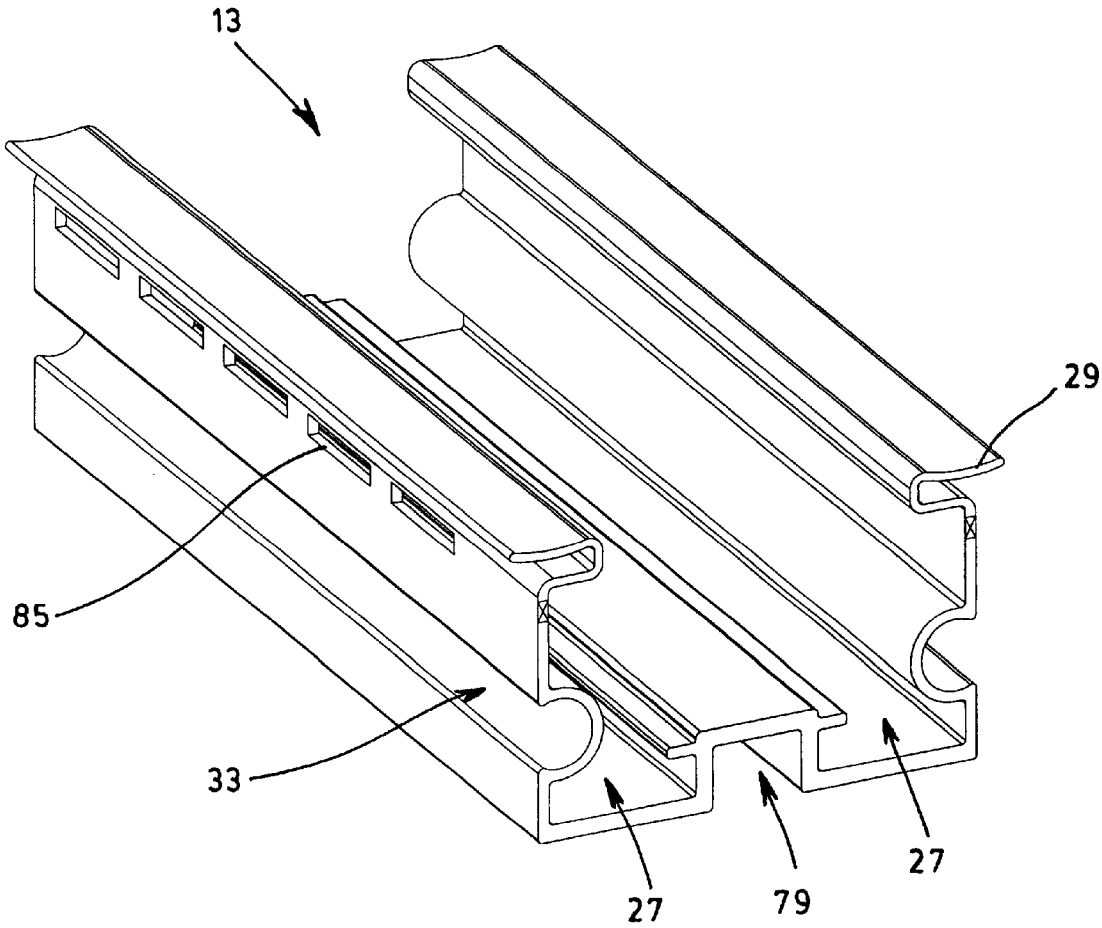
FIG. 20 is a perspective view of a punched solid panel vertical post according to a preferred embodiment of the invention.

Preferably, the vertical posts 13 may comprise punched marks 85 extending longitudinally along the vertical posts 13, the punched marks 85 being used for hooking accessories onto the vertical posts 13 of the panel system 1, as better shown in FIG. 20.

Preferably also, the moveable and demountable wall panel system 1 according to the present invention may also comprise a door assembly 87, as better shown in FIGS. 60–67.

Figure 8:
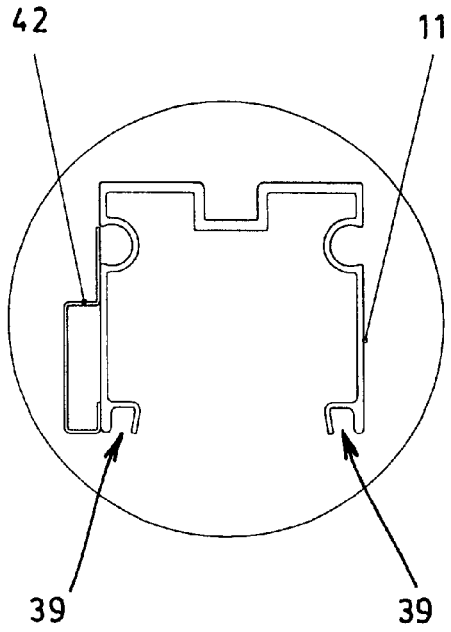
FIG. 8 is a cross-sectional view of the bottom distance channel and the bottom stiffener of the wall panel shown in FIG. 1.

Referring now to FIG. 1, there is shown an exploded perspective view of a solid wall panel 3 according to a preferred embodiment of the invention. As can be seen, the wall panel 3 preferably comprises two vertical members, known as "vertical posts" 13, which are connected to two horizontal members, known as "distance channels" 9, 11. The left and right vertical posts 13 are connected to the top and bottom distance channels 9, 11 to form a rectangular structural support frame 23. The vertical posts 13 are preferably connected to the distance channels 9, 11 by appropriate fasteners drilled into the sides of the vertical posts 13 and inserted into corresponding connecting studs 21 which are preferably securely affixed to the respective distance channels 9, 11, as better shown in FIGS. 1 and 2. The solid wall panel 3 preferably comprises also an outer panel covering 15 which is removably mounted onto the rectangular support frame 23 formed by the vertical posts 13 and the distance channels 9, 11. The outer panel covering 15 preferably comprises an outer panel shell 35, vertical stiffeners 37 securely mounted to the outer panel shell 35 for allowing the same to be removably fastened onto receiving grooves 33 of the vertical posts 13 of the panel 3, and intermediate and top and bottom stiffeners 41, 42, 47 mounted transversely to the outer panel shell 35. The intermediate stiffeners 47 are primarily used for providing the outer panel shell 35 with structural rigidity whereas the top stiffener 41 may be used for hooking and sustaining the outer panel shell 35 onto a corresponding receiving groove 39 of the top distance channel 9. Although the bottom stiffener 42 is preferably not hooked onto a similar groove 39 of the bottom distance channel 11, it nevertheless rests there against so as to ensure proper positioning of the outer panel covering 15 with respect to the bottom distance channel 11, as better shown in FIG. 8.

As also shown in FIG. 1, the wall panel 3 preferably also comprises a floor channel 19 which is destined to be securely affixed to the ground floor by means of suitable fasteners, such as carpet grippers for example. The wall panel 3 preferably also comprises left and right glide assemblies 25 for adjusting vertical positioning of the rectangular support frame 23 with respect to the articulating floor channel 19. Preferably also, the wall panel 3 comprises connectors 31 for connecting two neighboring vertical posts 13 and thus adjoining two vertical wall panels 3 together. As better shown in FIG. 21, the top portion of the vertical post 13 is preferably notched to allow the guiding rail 17 to pass therethrough. As it can be easily understood, once an appropriate wall panel 3 is assembled, it may be installed into the ceiling rail 17 at an angle and then swiveled towards the vertical axis 5 in order to properly secure the articulating floor channel 19 to the ground floor and then adjust positioning of the rectangular support frame 23 with respect to the ceiling rail 17 by means of the glide assemblies 25. Once the wall panel 3 is properly positioned in a vertical upright position, it is preferably provided with a base cover 71 so as to conceal the floor channel 19, the bottom distance channel 11 and the glide assemblies 25. The connectors 31, panel coverings 15, and base covers 71 are preferably shaped and sized so as to provide to the wall panel system 1 with a very sleek and clean look, as shown in the accompanying drawings.

Figure 2:
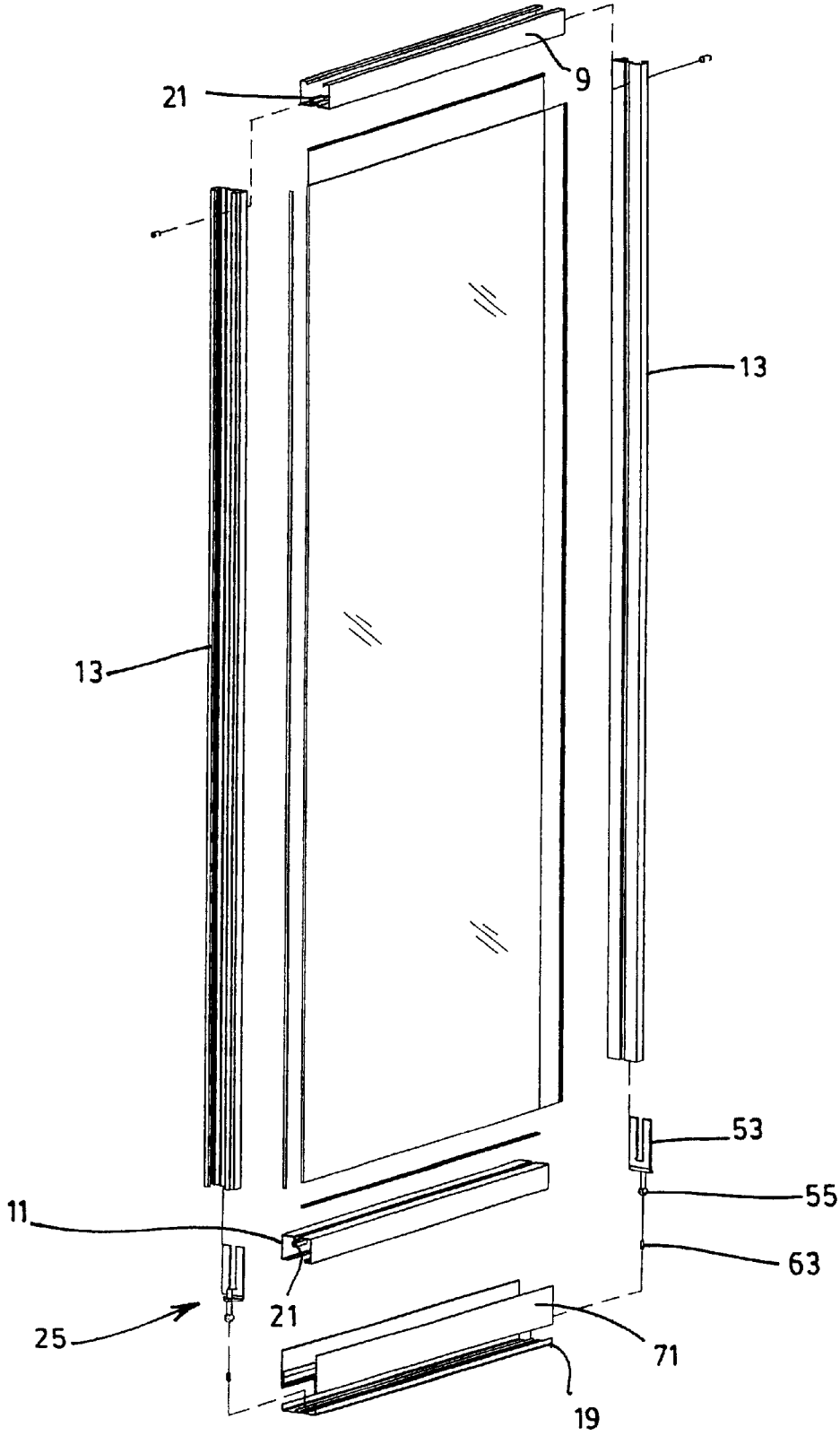
FIG. 2 is an exploded perspective view of a glass wall panel according to a preferred embodiment of the invention.

Referring now to FIG. 2, there is shown an exploded perspective view of a glass wall panel 3 according to a preferred embodiment of the invention. Similarly to the wall panel 3 shown in FIG. 1, the glass panel 3 shown in FIG. 2 comprises left and right vertical posts 13, top and bottom distance channels 9, 11, a floor channel 19 and glide assemblies 25. Once again, the vertical posts 13 and the distance channels 9, 11 are connected to one another so as to form a rectangular support frame 23 and the glide assemblies 25 cooperate with such rectangular support frame 23 so as to be able to displace it vertically in order to adjust the positioning of the wall panel 3 with respect to the ceiling. As shown in FIG. 2, a glass panel 3 is inserted into respective grooves of the vertical posts 13 and distance channels 9, 11, these grooves are commonly known as "interseptum" 79, or "intersepta" (plural). Preferably, appropriate glazing gaskets are used between these grooves and the glass panels 3 so as to provide the wall panel 3 with appropriate sound proofing, light proofing and vibration proofing. The glass panel 3 also preferably comprises a floor channel 19 which is devised to be securely affixed to the ground floor and also preferably comprises a base cover 71 with functions similar to the ones described for FIG. 1. Similarly to the above-mentioned, the vertical posts 13 are connected to the horizontal distance channels 9, 11 by appropriate fasteners which are inserted into the side portions of the vertical posts 13 and into corresponding connecting studs 21 which are preferably securely affixed to the top and bottom distance channels 9, 11, as explained and illustrated hereinabove.

Figure 9:
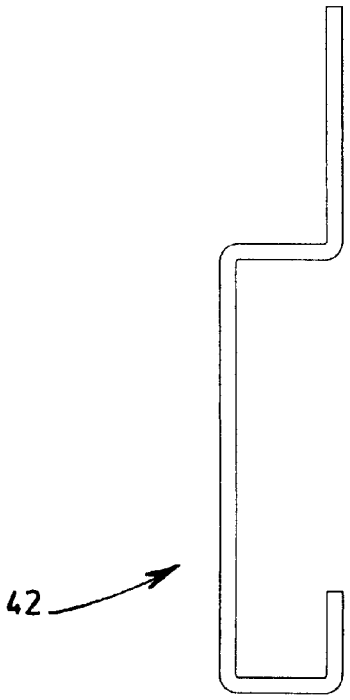
FIG. 9 is a cross-sectional view of the bottom stiffener shown in FIG. 8.

As better shown in FIG. 3, the intermediate stiffeners 47 are devised to be securely affixed onto the outer panel shell 35 in order to, among other things, provide the same with increased rigidity. Preferably also, the top stiffener 41 is to be securely affixed to a top lateral side of the outer panel shell 35 and is to be used for hooking the outer panel covering 15 onto a corresponding groove 39 provided to that effect on the top distance channel 11 of the panel 3. As also shown, the horizontal bottom stiffener 42 is intended to be securely affixed to the bottom portion of the outer panel shell 35 and to cooperate with the bottom distance channel 11 in the preferred manner better illustrated in FIG. 9. As better shown in FIG. 3, the outer panel covering 15 of a solid panel 3 preferably comprises an outer panel shell 35, intermediate stiffeners 47, top and bottom stiffeners 41, 42, and vertical stiffeners 37. As mentioned hereinabove, the vertical stiffeners 37 are preferably securely affixed to the outer panel shell 35 along the left and right internal sides thereof and are intended primarily to removably fasten the outer panel covering 15 onto the corresponding receiving grooves 33 of the vertical posts 13 of the panel 3, as better shown in FIG. 1.

Figure 7:
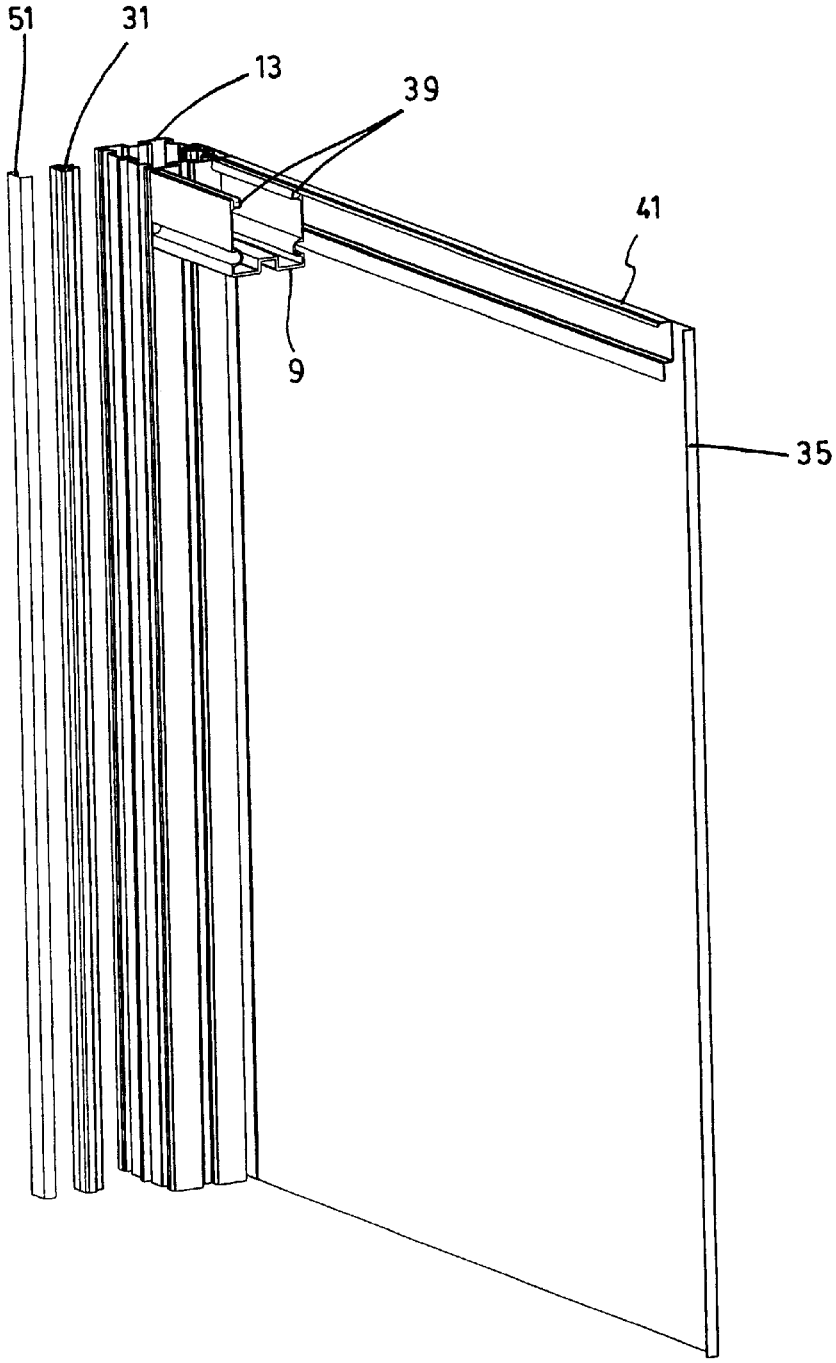
FIG. 7 is a partial sectional exploded view of some of the components of the wall panel shown in FIG. 1.

Referring now to FIG. 7, there is shown a partial sectional exploded view of some of the components of the wall panel 3 shown in FIG. 1. More particularly, there is shown a cross-sectional configuration of the top distance channel 9 according to a preferred embodiment of the invention. Indeed, the distance channel 9 comprises grooves 33 for removably receiving optional horizontal stiffeners (not shown) of the outer panel coverings 15. The distance channel 9 also preferably comprises a corresponding groove 39 for receiving a top stiffener 41 of the outer panel covering 15. Preferably also, the distance channel 9 also comprises a longitudinal interseptum 79 for receiving different modular components of the wall panel system 1, such as a glass panel 3, as in the case of FIG. 2. It is worth mentioning here that other shaped and sized intersepta 79 may be used for mounting different accessories thereon, such as blinds for example. As also shown in FIG. 7, two vertical posts 13 are preferably adjoined to one another so as to connect two neighboring wall panels 3 by means of a connector 31 which may or may not be provided with a covering cap 51. The covering cap 51 of the connector 31 is preferably selected to match the outer surface of the outer panel covering 15 (i.e. the outer panel shell 35). It is worth mentioning that different finishes and textures may be used for the covering cap 51 of the connector 31 as well as for the outer panel shell 35 of the panel covering 15, depending on the particulars of a user of the wall panel system 1, as apparent to a person skilled in the art. For example, the covering cap 51 and the outer panel shell 35 may have a wood finish, a metallic finish, an upholstery finish, etc., and may be similar to one another or different from each other, depending on the particular wants and needs of a user of the wall panel system 1. Advantageously, because all of the above-mentioned components of the wall panel system 1 are removably mountable and demountable onto the wall panel 3, one may mix and match different configurations, as need may be.

Figure 10:
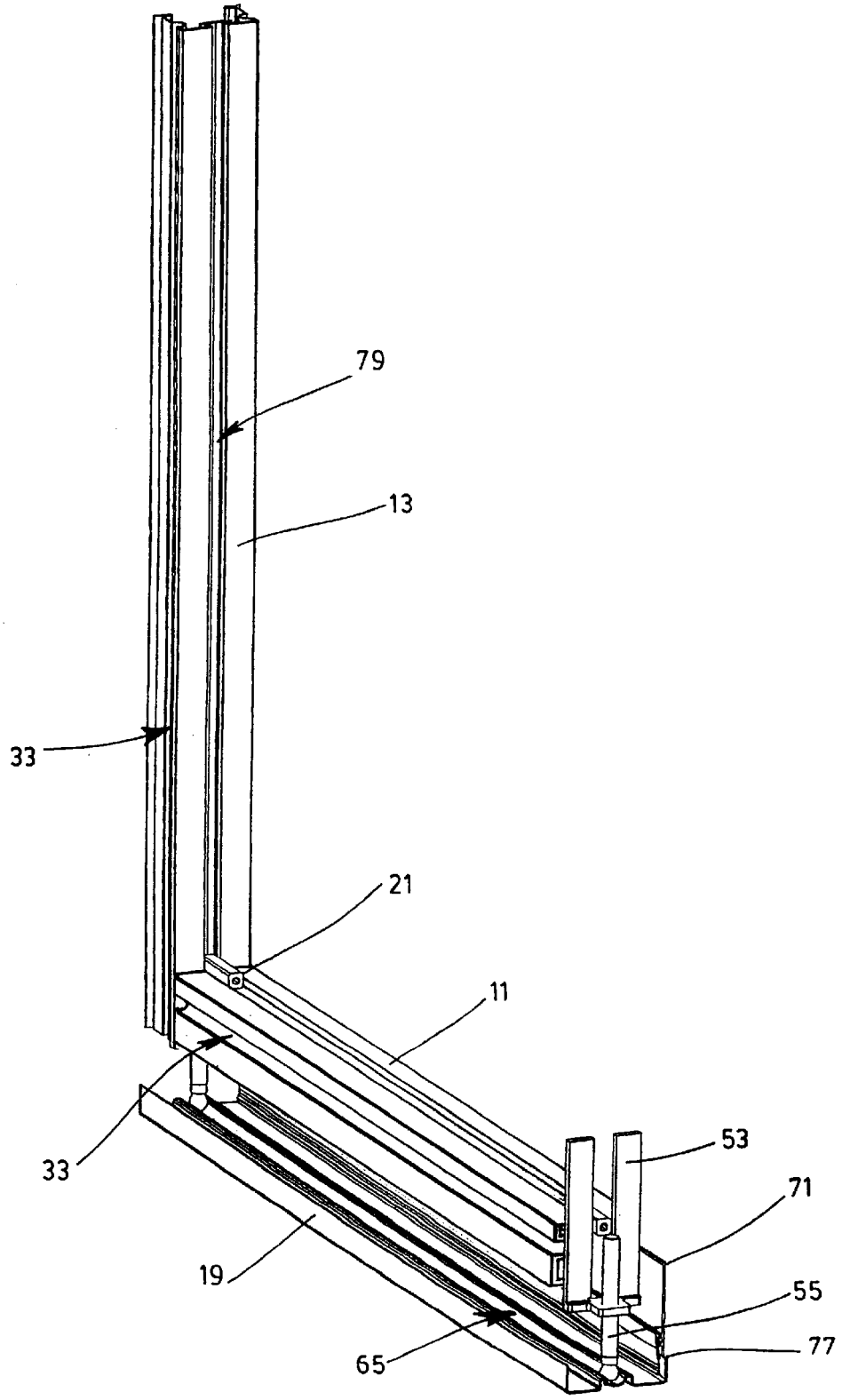
FIG. 10 is a partial sectional perspective view of some of the components of the wall panel shown in FIG. 1.

Referring now to FIG. 10, there is shown a partial sectional perspective view of some of the components of the wall panel 3 shown in FIG. 1. As illustrated in this figure, and as can be easily understood, the glide assemblies 25 enable to adjust vertically the rectangular structural support frame 23 formed by the vertical posts 13 and horizontal top and bottom distance channels 9, 11 with respect to the floor channel 19, and consequently with respect to the ceiling, or the ceiling rail 17 which is preferably affixed thereto according to the present invention. Caddy™ clips are preferably used for affixing the ceiling rail 17 to the ceiling surface, although other suitable fasteners may be used, as apparent to a person skilled in the art.

As better shown in FIGS. 11 and 12, the glide assemblies 25 preferably comprise a glide bolt 55, a glide 53, and a fastener. The glide 53 preferably comprises two tongues 69 which are insertable into corresponding grooves 33 of the vertical posts 13 and an abutment flange 57 which preferably extends perpendicularly with respect to the tongues 69 so as to form an abutment with the vertical post 13, as better shown in FIG. 12. The abutment flange 57 is preferably threadedly mounted onto the glide bolt 55 so as to enable a relative movement between the glide 53 and the glide bolt 55 by rotation of the glide bolt 55. Preferably, as also shown in FIGS. 11 and 12, the glide bolt 55 preferably comprises a pivot head 61 which is operatively connected to the floor channel 19 by means of a suitable fastener, the latter guiding the sliding of the glide bolt 55 along a corresponding slot 67 of the floor channel 19, as better shown in FIG. 12. Preferably also, the fastener connecting the glide bolt 55 to the floor channel 19 is a rivet 63, although other suitable means may be used, as apparent to a person skilled in the art. Preferably also and as better shown in FIG. 23, the glide bolt 55 has a square cross-sectional portion so as to facilitate rotation thereof by suitable means, such as a conventional wrench for example.

As can be easily understood, since the floor channel 19 is securely affixed to the floor, when the glide 53 is moved with respect to the glide bolt 55 vertically, then so will the vertical post 13 with respect to the floor because of the abutment of the flange 57 against the bottom portion of the vertical post 13, as better shown in FIG. 12.

FIG. 11 also shows how the connecting stud 21 is preferably securely affixed to the bottom distance channel 11.

Figure 13:
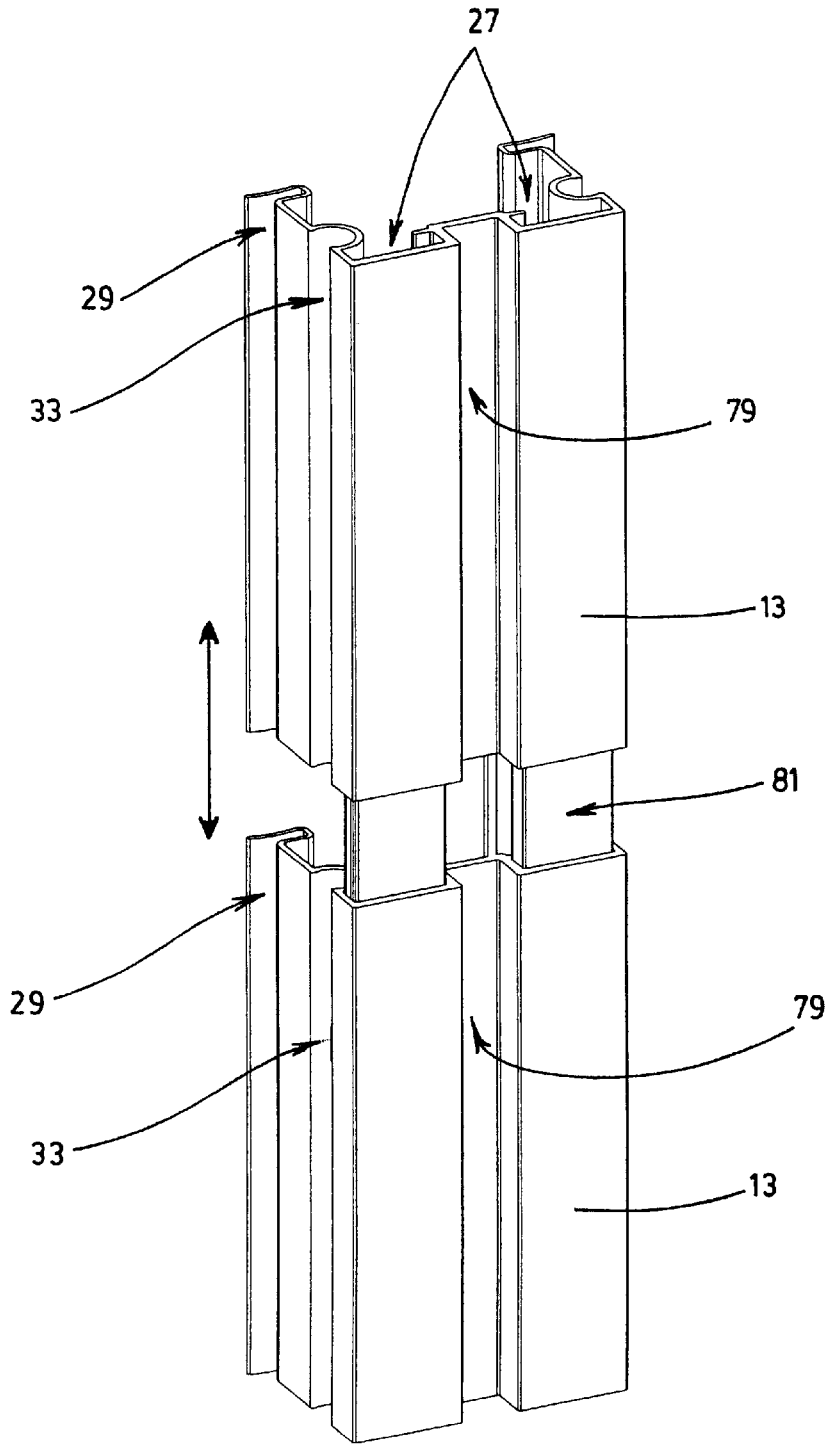
FIG. 13 is an exploded perspective view of a stackable flyover cooperating with two vertical posts according to a preferred embodiment of the invention.

Referring now to FIGS. 13–19, and particularly to FIG. 13, there is shown a perspective view of a stackable flyover 81 cooperating with two vertical posts 13 of two wall panels 3 intended to be stacked onto one another. As can be easily understood, the stackable flyover 81 is used to connect adjoining vertical posts 13, i.e. stacked them together, so as to enable to stack wall panels 3 onto one another. Among many other functions, the stackable flyover 81 is intended to impart to the vertical posts 13 with a sound structural integrity, as well as to provide both wall panels 3 stacked together with sound structural stability. The stackable flyover 81 is preferably devised to be snuggly inserted into the receiving channels 33 of the vertical posts 13 so as to enable quick and easy assembling of the same, by light taping for example. Preferably also, the stackable flyover 81 is made of a suitable material, so as to not allow jigger and so as to sustain the loads of the vertical posts 13 connected thereto, as apparent to a person skilled in the art.

Figure 14:
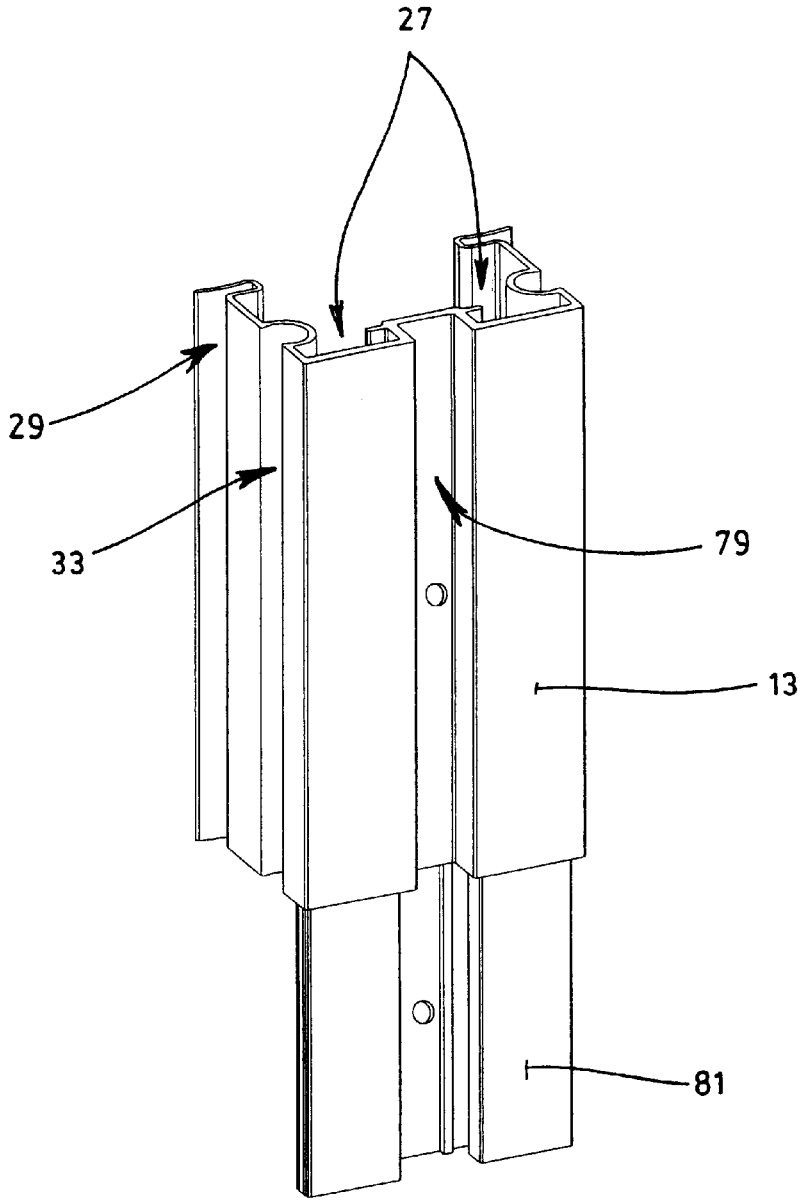
FIG. 14 is a partial enlarged view of what is shown in FIG. 13.
Figure 15:
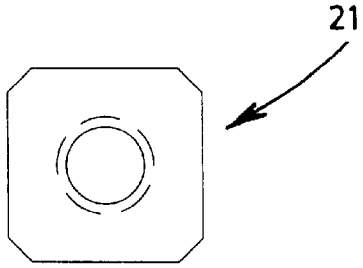
FIG. 15 is a cross-sectional view of a connecting stud according to a preferred embodiment of the invention.
Figure 16:
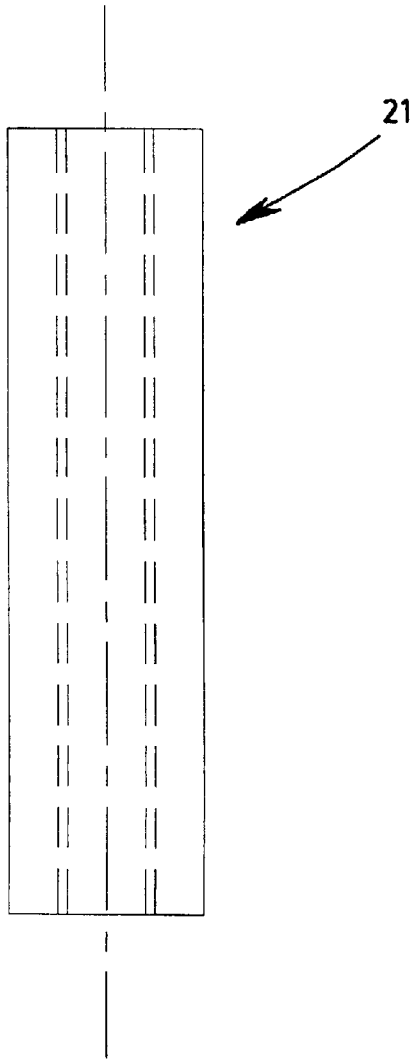
FIG. 16 is a side elevational view of the connecting stud shown in FIG. 15.

According to the preferred embodiment of the invention, holes are drilled through the assembled vertical posts 13 and through the stackable flyovers 81 at predetermined ranges, as better shown in FIG. 14, and then suitable connecting fasteners are preferably passed therethrough, and into the connecting studs 21, as can be inferred from in FIGS. 1 and 2, so as to hold the entire wall panel, formed of stacked panels 3, together. Therefore, the vertical posts 13 are operatively connected to the connecting studs 21 of the horizontal distance channels 9, 11, whether simple or transition distance channels 9, 11, by means of the stackable flyovers 81 and appropriate connecting fasteners, as apparent to a person skilled in the art.

Preferably, the connecting stud 21 is a threaded metal receptacle that allows the connecting fasteners, such as screws for example, to be affixed to the distance channels 9, 11.

As can be easily understood, by inserting the connecting screws into the connecting studs 21, one is able to align both stackable panels 3 and keep them in position with respect to one another.

Figure 17:
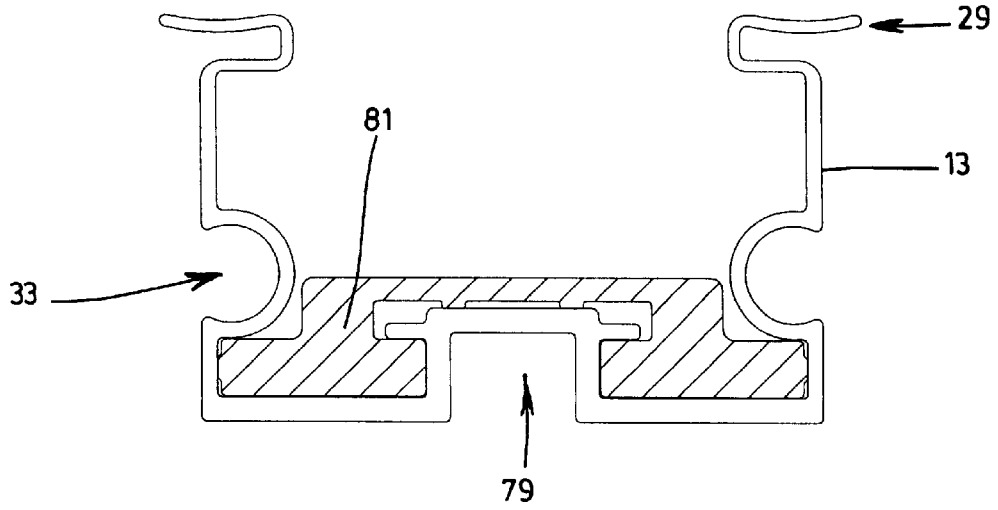
FIG. 17 is a cross-sectional view of what is shown in FIG. 14.
Figure 18:
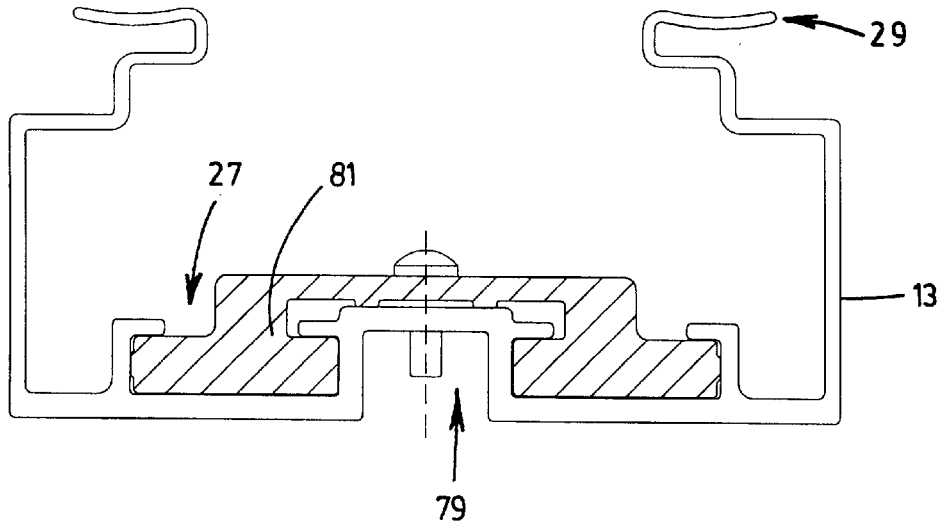
FIG. 18 is a cross-sectional view of what is shown in FIG. 17 according to another preferred embodiment of the invention.

As better shown in FIGS. 13, 14 and 17, the vertical post 13 preferably comprises a receiving groove 33 for receiving the vertical stiffeners 37 of the panel coverings 15. Preferably, these receiving grooves 33 are a half-round arc of about 270° sweep. The vertical post 13 also preferably comprises a longitudinal groove, known as an "interseptum" 79 and panel-to-panel receiving lips 29, said panel-to-panel receiving lips 29 being used for receiving the panel-to-panel connectors 31, as explained hereinabove. Preferably, the receiving lips 29 and the connectors 31 are preferably devised to be removably insertable and connectable onto one another.

In general, the vertical post 13 is one of the main vertical structural members of the wall panel support frame 23 and as a result thereof, may also be provided with punch marks 85, as shown in FIG. 20, to receive slotted standards that could be used to hold shelf brackets or even hang other suitable accessories, such as overhead cabinets for example, as apparent to a person skilled in the art.

Figure 19:
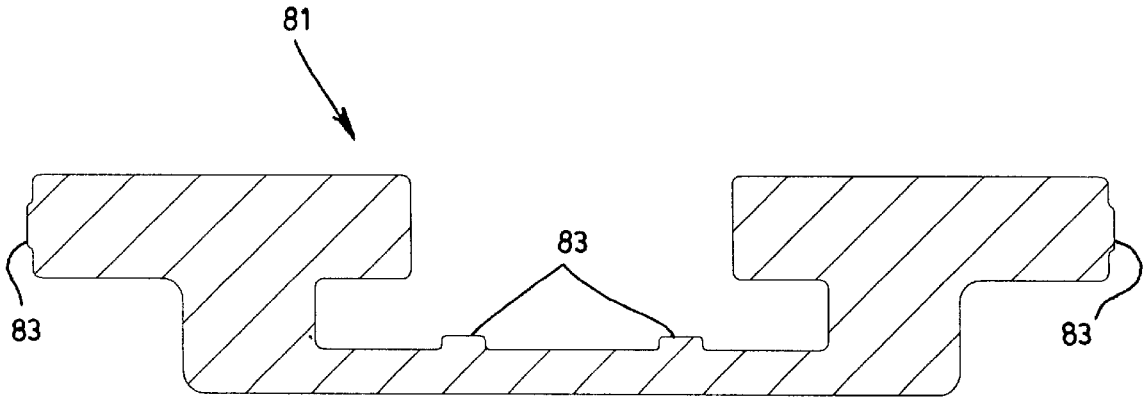
FIG. 19 is a cross-sectional view of the stackable flyover shown in FIG. 17.

Preferably, as better shown in FIG. 19, the stackable flyover 81 comprises interference ribs 83 with are used to decrease to an appropriate extent surface contact between the stackable flyover 81 and the corresponding receiving channels 33 of the vertical posts 13 so as to ensure a proper cooperation between the latter two.

Referring now to FIGS. 21 and 22, one can see a preferred embodiment of the ceiling rail 17 according to the present invention. As better shown in FIG. 21, the ceiling rail 17 is preferably connected to the ceiling by means of suitable fasteners, such as caddy™ clips for example, and is preferably provided with a closed cell gasket to ensure once again, sound proofing, light proofing, and vibration proofing of the wall panel system 1. The ceiling rail 17 has two projecting members which are preferably designed to be inserted into corresponding notched grooves of the vertical posts 13, and into the inside of the top distance channel 9. The ceiling rail 17 is preferably provided with oblong orifices provided at appropriate locations along the rail 17 so as to properly fasten the rail 17 to the ceiling surface, as apparent to a person skilled in the art.

Figure 23:
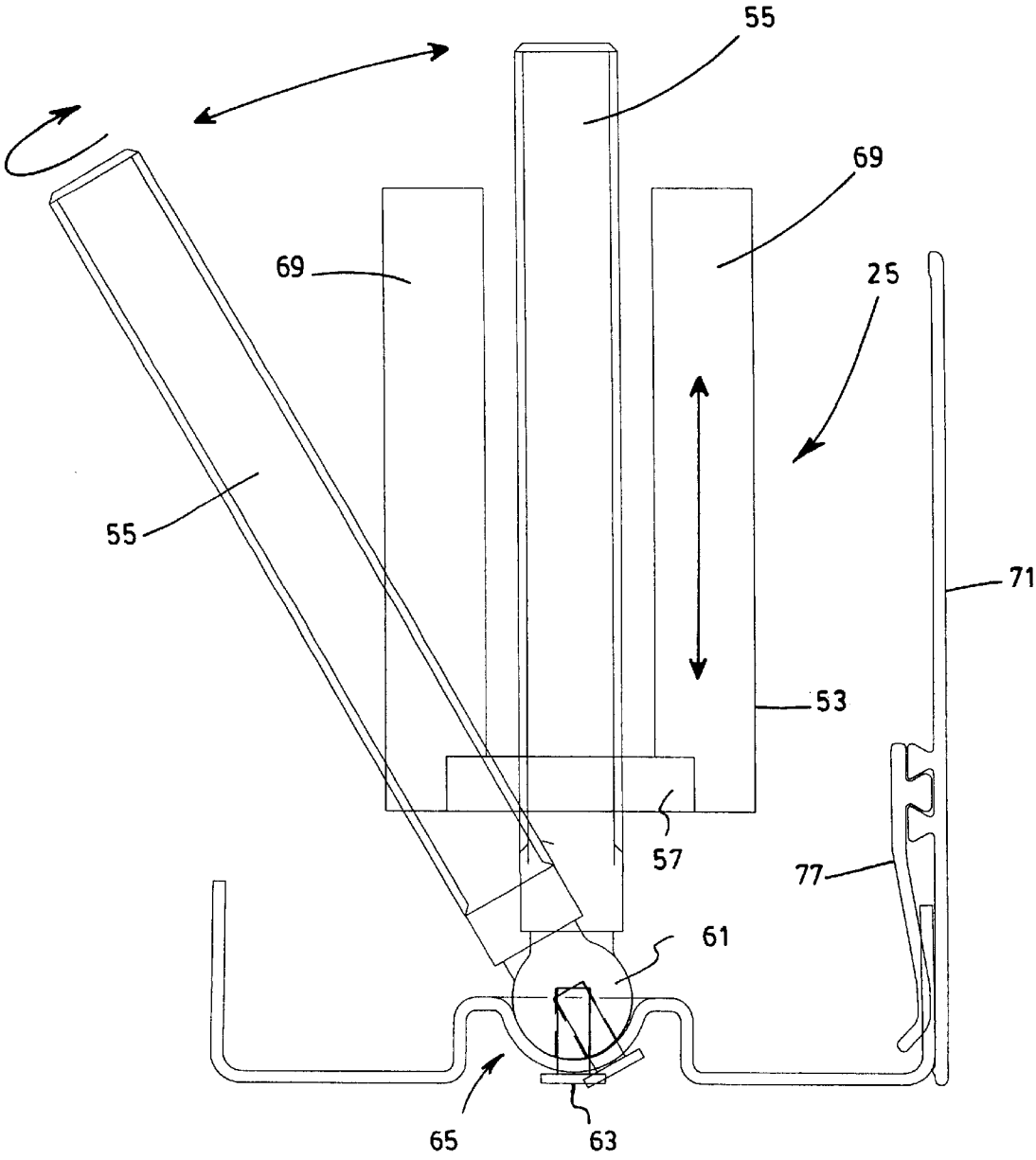
FIG. 23 is a sectional view of a glide assembly of the wall panel shown in FIG. 1, said glide assembly being shown cooperating with a floor channel according to a preferred embodiment of the invention.

Referring now to FIG. 23, there is shown a sectional view of the glide 53, glide bolt 55, articulating floor channel 19, and base cover 71 of the wall panel 3 shown in FIG. 1. As explained hereinabove, the glide 53 of the glide assembly 25 preferably comprises two tongues 69 which are to be inserted into corresponding receiving channels 33 of the vertical posts 13 and preferably also comprises an abutment flange 57 for sustaining the vertical post 13 into which the tongues 69 have been inserted. Preferably also, the glide bolt 55 is provided with an appropriate threading therealong so that the glide 53 may be threadedly engaged with the same so as to ensure proper relative displacement between the two. Preferably also, the glide bolt 55 comprises a pivot head 61 which is connected to a corresponding groove 65 of the floor channel 19 by means of a fastener, such as a rivet 63 for example. The pivot head and rivet assembly of the glide bolt 55 enable the same to rotate about the groove 65 of the floor channel 19 along a slot 67 provided to that effect, as better shown in FIG. 12. Preferably also, the glide bolt 55 is provided with a square cross-sectional section so as to enable suitable rotating means, such as a ratchet or a wrench for example, to rotate the glide bolt 55 so as to displace the glide 53 with respect to the glide bolt 55, as apparent to a person skilled in the art. By doing so, since the glide 53 is in an abutment relationship with the vertical post 13, one may adjust vertical displacement of the wall panel 3 with respect to the ceiling and/or ground floor by appropriately turning the glide bolt 55 with respect to the glide 53 of the glide assembly 25. Preferably, as also shown in FIG. 3, the wall panel 3 comprises a base cover 71 which comprises a covering, and a cover insert 77 which is preferably removably connectable to the covering, so as to define a slit enabling sliding of the base cover 71 onto a projecting member of the floor channel 19. Preferably, suitable foam tapes are provided between the floor channel 19 and the ground in order to further provide the wall panel system 1 with light proofing, sound proofing, and vibration proofing.

Referring now to FIG. 25, there is shown a partial sectional view of two panel coverings 15 mounted onto a vertical post 13 by means of vertical stiffeners 37. As shown in this figure, the outer panel coverings 15 are preferably mounted to the vertical post 13 by means of vertical stiffeners 37, which are intended to be removably mountable into corresponding grooves 33 of the vertical posts 13. As better shown in FIG. 26, the vertical stiffeners 37 preferably comprise a bracket 43 which is intended to be securely affixed to the outer panel shell 35 of the panel covering 15 and further comprise a flexible clip 45 which is removably insertable into the corresponding grooves 33 shown in FIG. 25. The vertical clip 45 according to the preferred embodiment shown in FIG. 26 is advantageous in that it offers a circular configuration and comprises two compressible wings which enable the panel coverings 15 to be mounted onto the vertical posts 13 with a certain slack and play.

FIG. 27 is a partial cross-sectional view of a wall assembly according to a preferred embodiment of the invention. FIG. 27 shows two vertical posts 13 which are connected to one another by means of connectors 31. Furthermore, panel coverings 15 are mounted onto the vertical posts 13 by means of their vertical stiffeners 37. Furthermore, according to this particular embodiment of the invention, the connectors 31 are preferably devised to ensure a flush surface with the outer panel shells 35 of the panel coverings 15.

Figure 28:
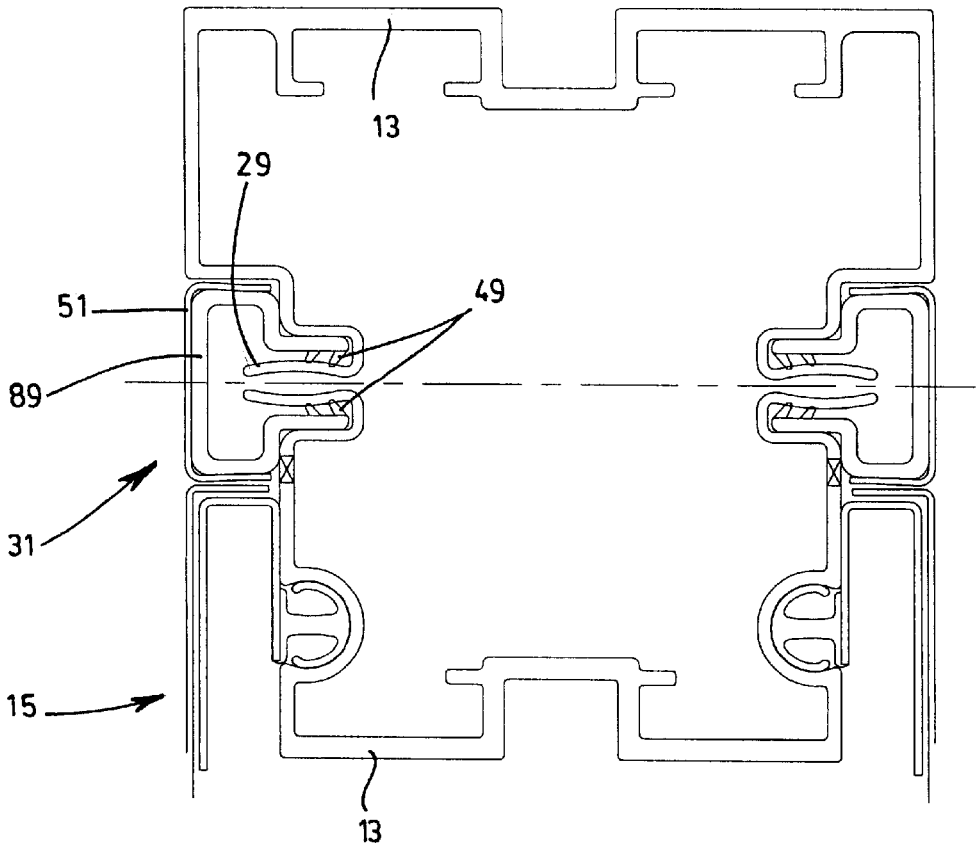
FIG. 28 is a wall panel assembly according to yet another preferred embodiment of the invention.
Figure 29:
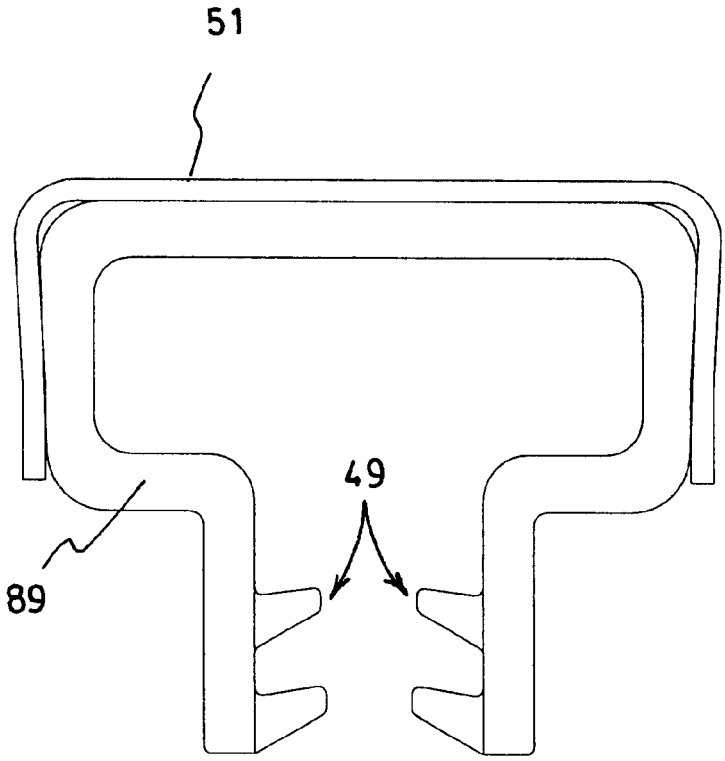
FIG. 29 is a cross-sectional view of the connector shown in FIG. 28.

As better shown in FIG. 29, the flush connector 31 which is used to connect two neighboring vertical posts 13, such as in the case of FIGS. 27 and 28, preferably comprises a connecting portion 89, and a covering cap 51. The connecting portion 89 is preferably made of a suitable material, such as PVC for example, and preferably comprises fins 49 which are intended to further increase gripping and mounting of the connector 31 onto the receiving lips 29 of the vertical posts 13, and to further increase sound proofing, light proofing, and vibration proofing of the wall panel system 1. The different components of the connecting portion 89 are preferably made integral to each other, that is are preferably made into one single piece from one single material. Preferably also, the covering cap 51 of the connector 31 is preferably connected to the connecting portion 89 by suitable means, as apparent to a person skilled in the art.

Figure 30:
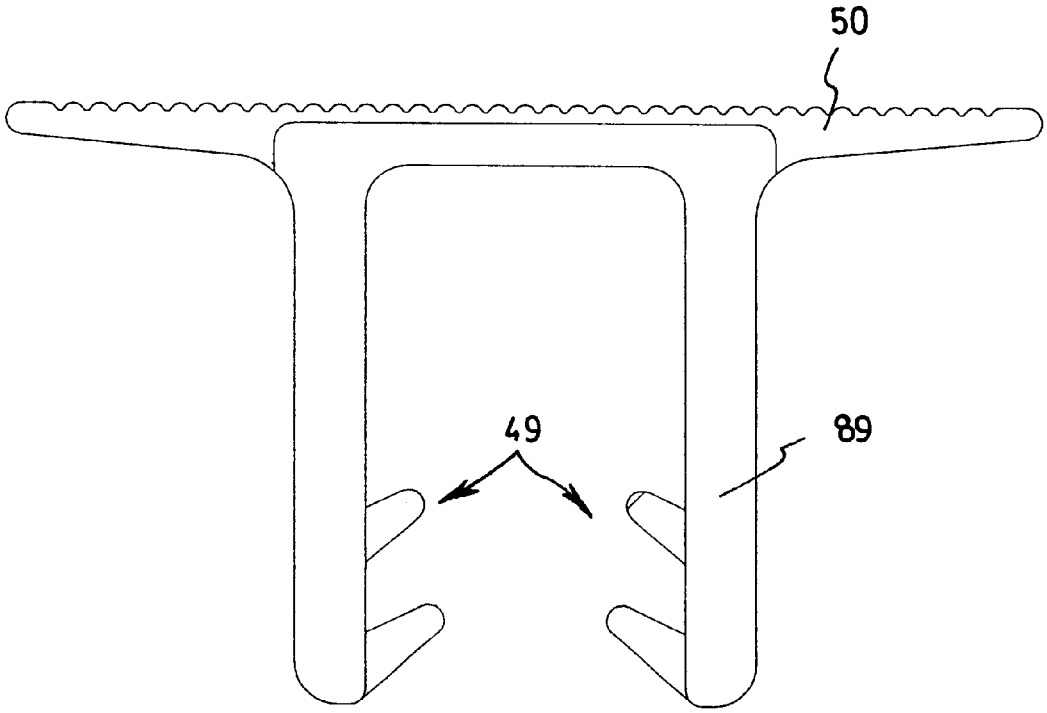
FIG. 30 is a cross-sectional view of a connector according to another preferred embodiment of the invention.

FIG. 30 illustrates a recessed connector 31 which may be used to adjoin neighboring vertical posts 13, similarly to the connector 31 shown in FIG. 29, while enabling a recessed cavity between two neighboring vertical posts 13. Indeed, it is worth mentioning here that different types of connectors 31, such as the one shown in FIGS. 29 and 30, may be used to provided the outer part of the wall panel system 1 with different esthetic configurations.

Figure 31:
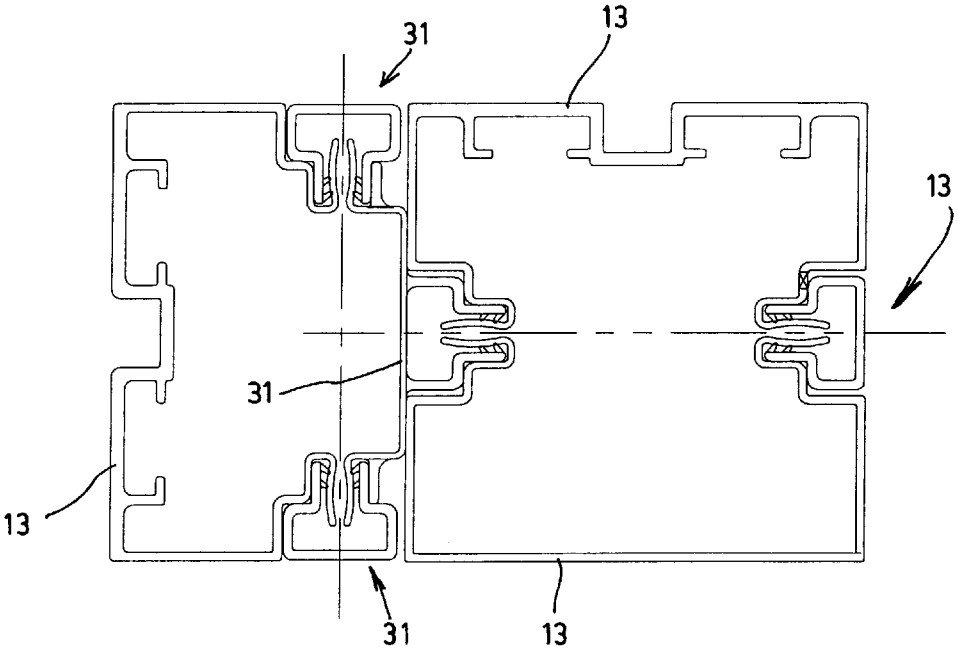
FIG. 31 is a wall panel assembly according to yet another preferred embodiment of the invention.
Figure 32:
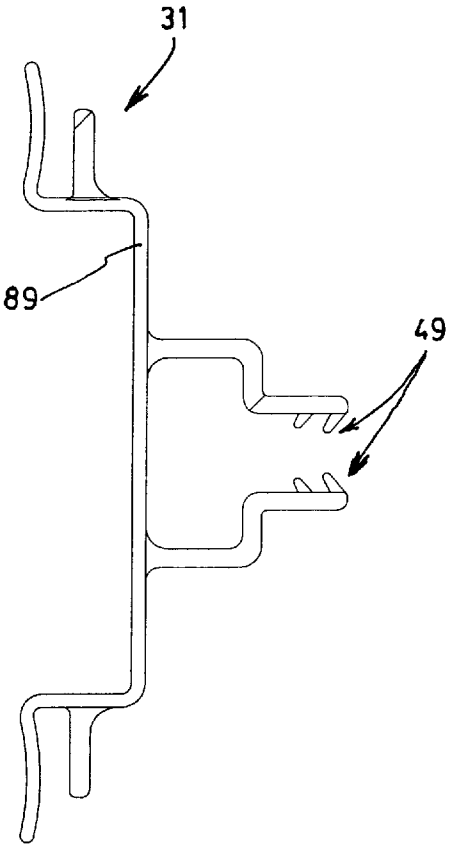
FIG. 32 is a cross-sectional view of the building module connector shown in FIG. 31.

FIG. 32 shows a preferred embodiment of a building module connector 31 allowing adjacent 90° corners to be connected in a non-progressive manner, such as in the case of FIG. 31.

FIGS. 33 to 59 illustrate different embodiments of the components discussed hereinabove.

Figure 34:
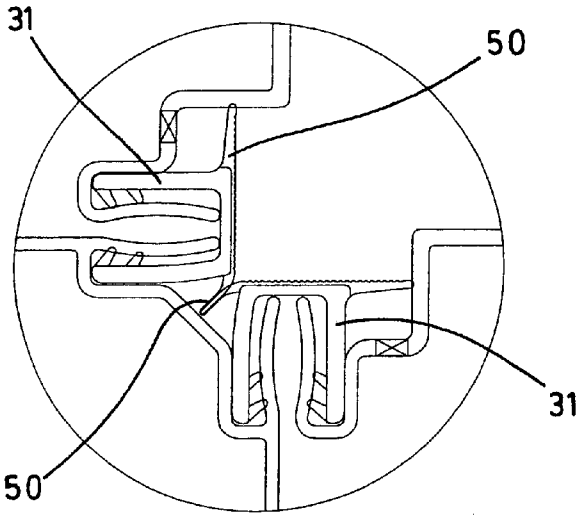
FIG. 34 is an enlarged cross-sectional view of a portion shown in FIG. 33.
Figure 33:
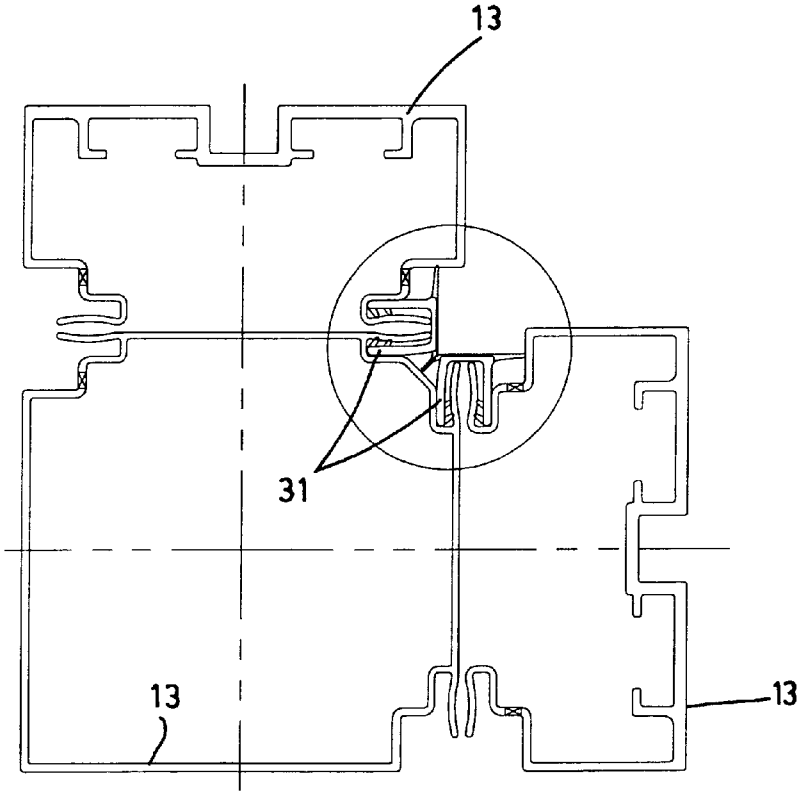
FIG. 33 is a cross-sectional view of a wall panel assembly according to yet another preferred embodiment of the invention.
Figure 35:
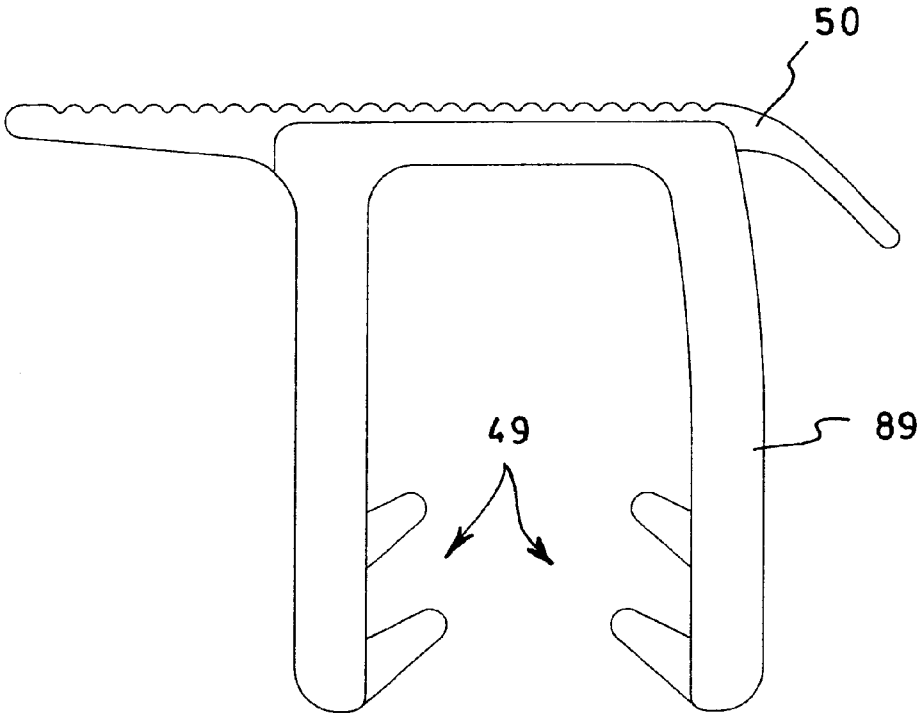
FIG. 35 is a cross-sectional view of the furniture module connector shown in FIG. 34.

More particularly, FIGS. 33 and 34 describe embodiments used for a furniture module connection in the case of a 90° corner. A furniture module connector 31 such as the one in FIG. 35, may be used. This type of connector 31 preferably comprises fins 49 for ensuring proper mounting of the connector 31 onto the receiving lips 29 of the different vertical posts 13 and also preferably comprises a flexible skirt 50 to ensure light proofing, sound proofing, and to some extent, vibration proofing, as apparent to a person skilled in the art.

Figure 36:
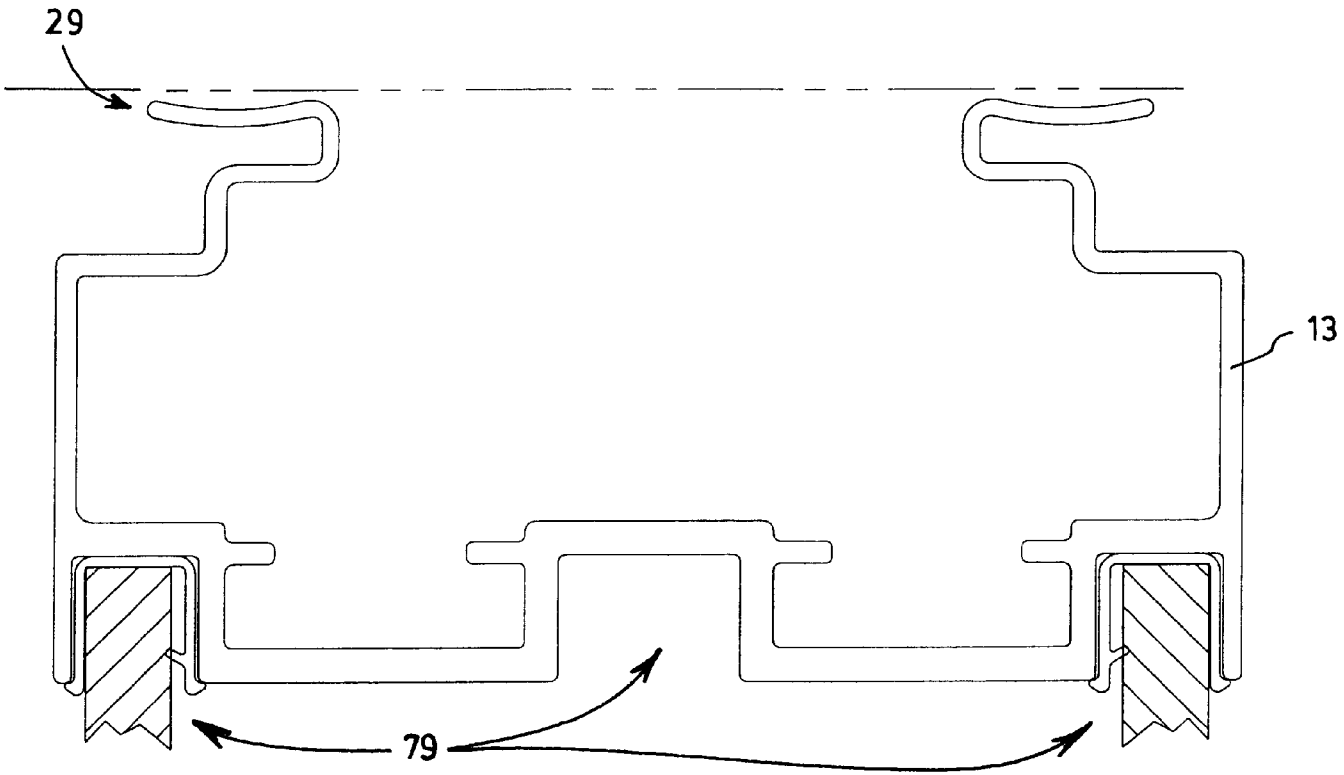
FIG. 36 is a partial cross-sectional view of a wall panel assembly according to yet another preferred embodiment of the invention.
Figure 37:
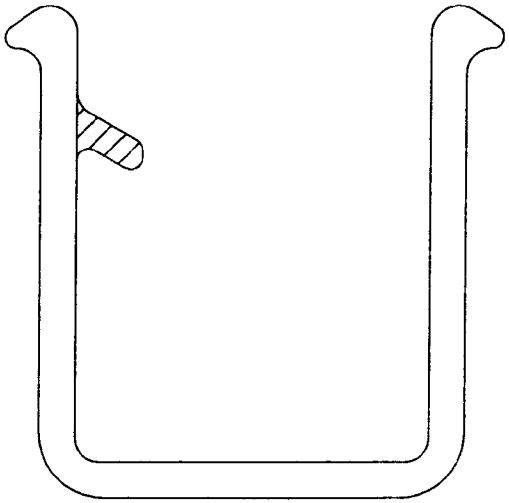
FIG. 37 is a cross-sectional view of the double glazing gasket shown in the wall panel assembly of FIG. 36.

FIG. 37 illustrates a double glazing gasket to be used in different possible wall assemblies, such as the one illustrated in FIG. 36, which corresponds to a double glaze vertical post assembly.

Figure 38:
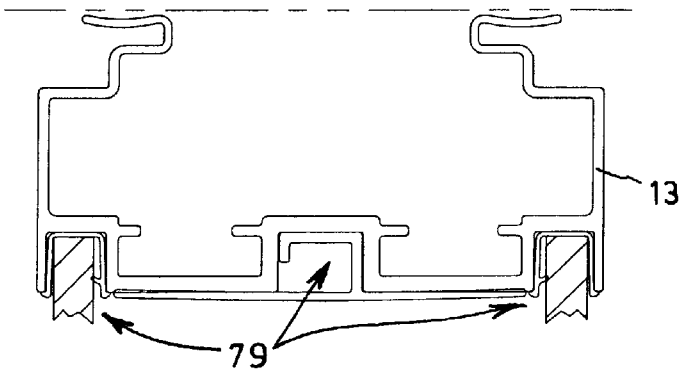
FIG. 38 is a partial cross-sectional view of a wall panel assembly according to yet another preferred embodiment of the invention.
Figure 39:
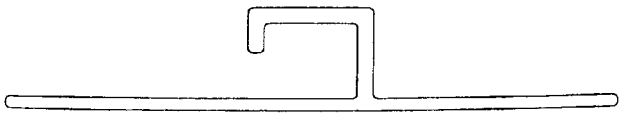
FIG. 39 is a cross-sectional view of the center cap shown in the wall panel of FIG. 38.

FIG. 38 shows another wall assembly comprising a center cap which is mounted onto the interseptum 79 of the vertical post 13 to provide a smooth finish between two glass panels 3 of a double glaze condition wall panel 3.

Figure 40:
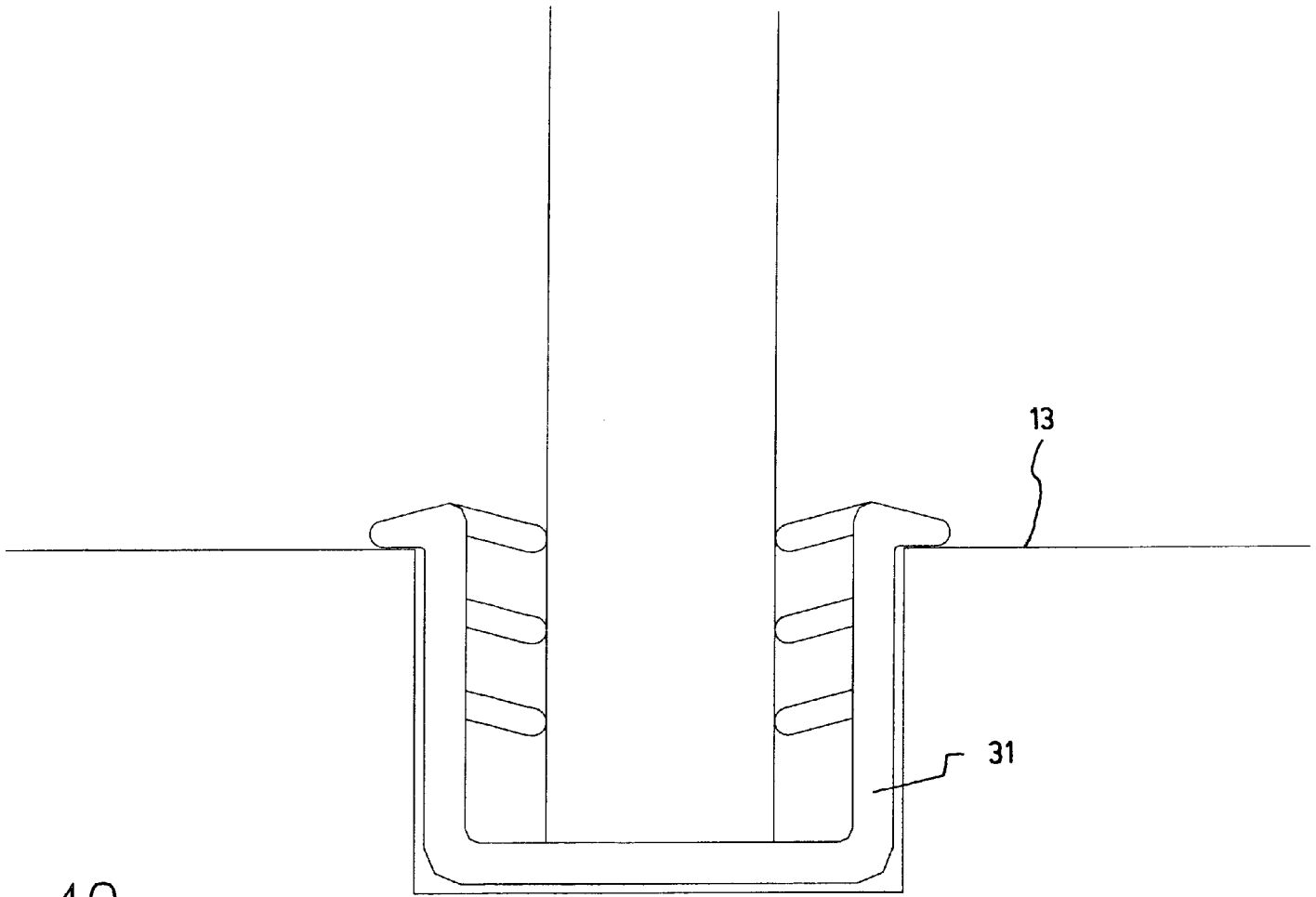
FIG. 40 is a partial cross-sectional view of a wall panel assembly according to yet another preferred embodiment of the invention.

A single glazing gasket such as the one shown in FIG. 40 may be used for a glass panel 3 such as the one illustrated in FIG. 2.

Figure 41:
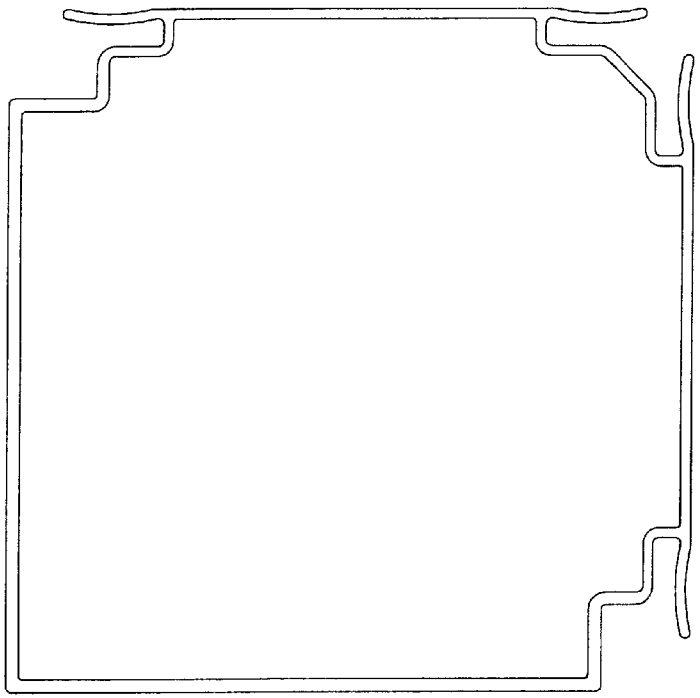
FIG. 41 is a cross-sectional view of a furniture module according to a preferred embodiment of the invention.
Figure 42:
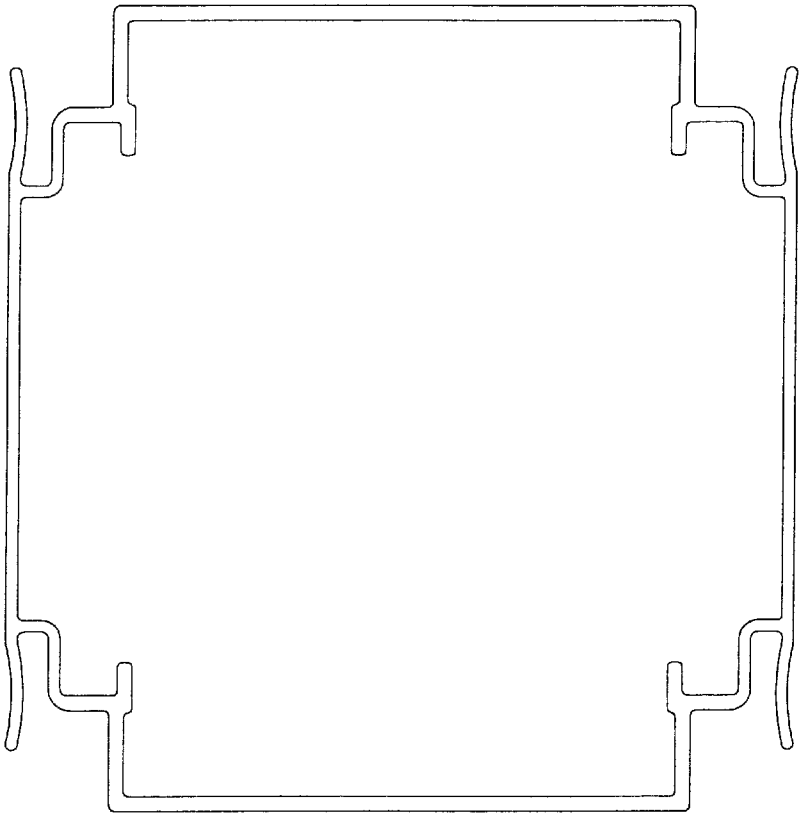
FIG. 42 is a cross-sectional view of a furniture module according to yet another preferred embodiment of the invention.
Figure 43:
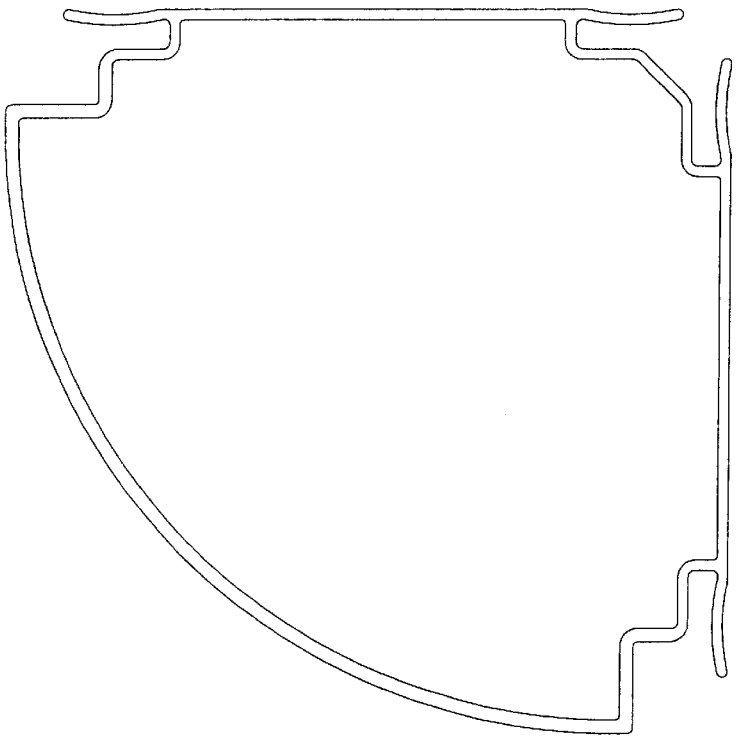
FIG. 43 is a cross-sectional view of a furniture module according to yet another preferred embodiment of the invention.
Figure 44:
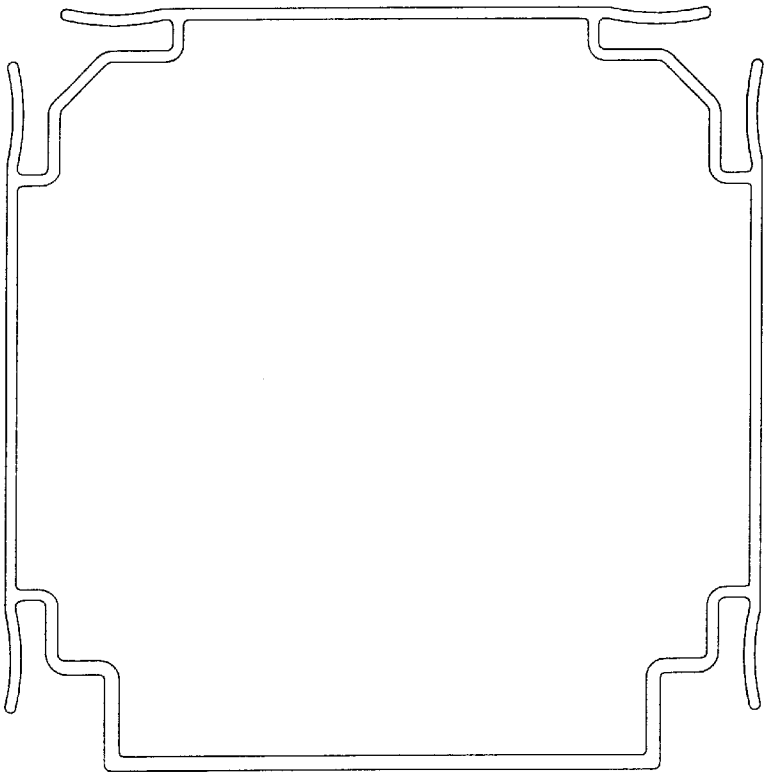
FIG. 44 is a cross-sectional view of a furniture module according to yet another preferred embodiment of the invention.
Figure 45:
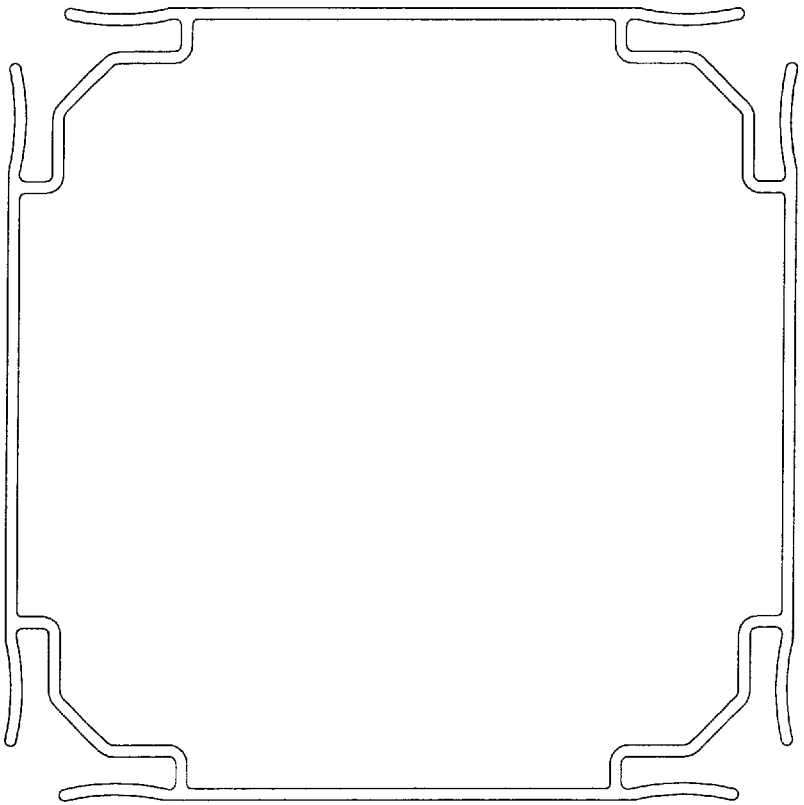
FIG. 45 is a cross-sectional view of a furniture module according to yet another preferred embodiment of the invention.

FIG. 41 illustrates a two-way square profile of a furniture module according to a preferred embodiment of the invention. FIG. 42 illustrates a 180° post furniture module according to a preferred embodiment of the invention. FIG. 43 illustrates a half-round two-way post corner furniture module according to a preferred embodiment of the invention. FIGS. 44 and 45 illustrate respectively three-way corner and four-way corner furniture modules.

Figure 46:
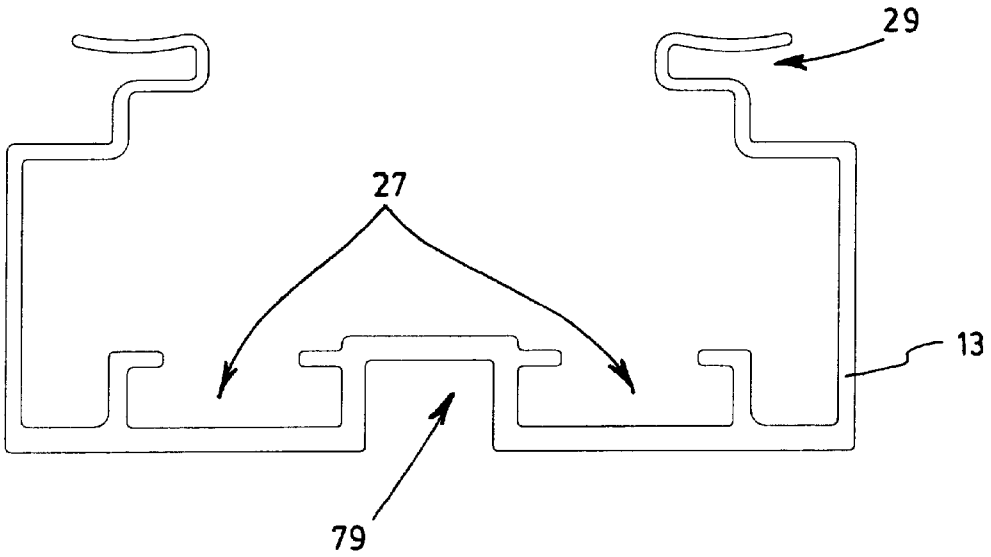
FIG. 46 is a cross-sectional view of a glass vertical post according to a preferred embodiment of the invention.
Figure 47:
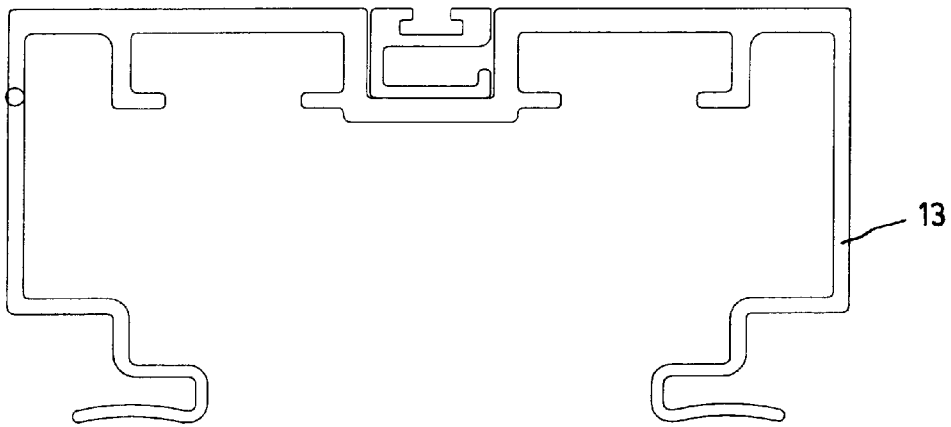
FIG. 47 is a cross-sectional view of a vertical post according to yet another preferred embodiment of the invention, said vertical post being shown with a weatherstrip holder mounted into the interseptum thereof.
Figure 48:
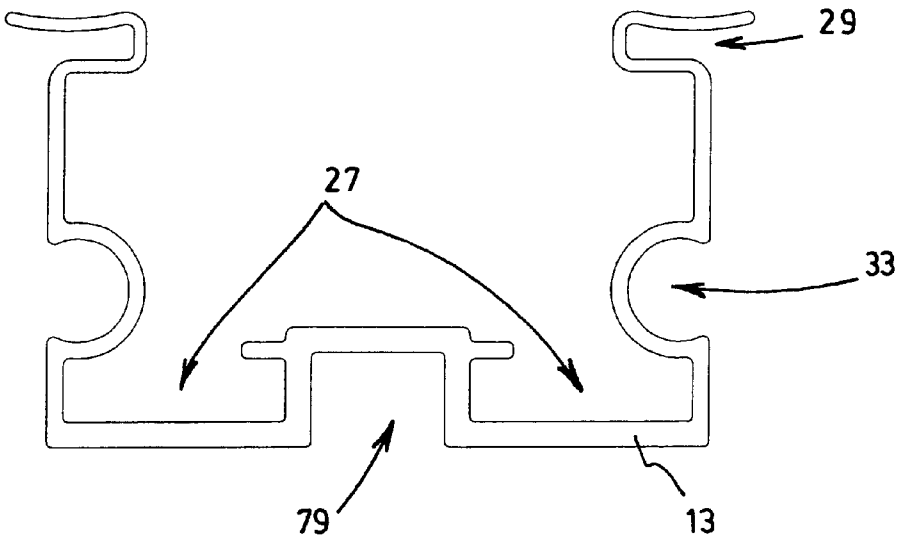
FIG. 48 is a cross-sectional view of a solid vertical post according to yet another preferred embodiment of the invention.
Figure 49:
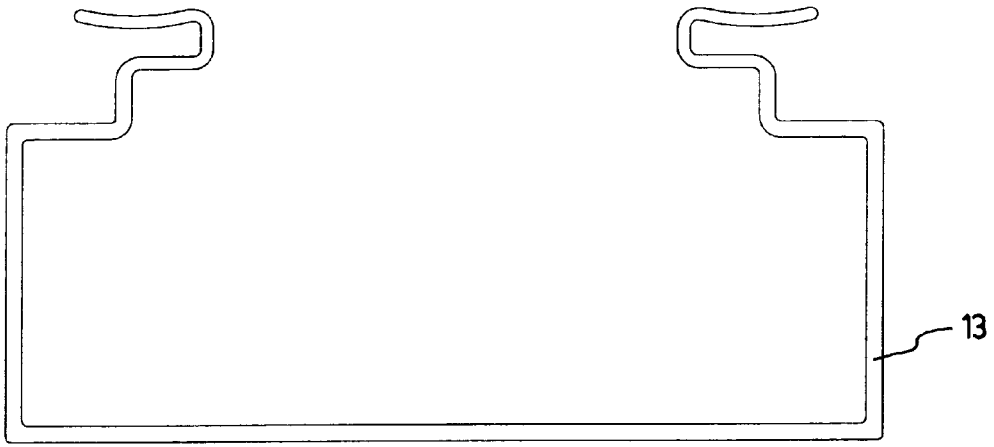
FIG. 49 is a cross-sectional view of a building module according to a preferred embodiment of the invention.
Figure 50:
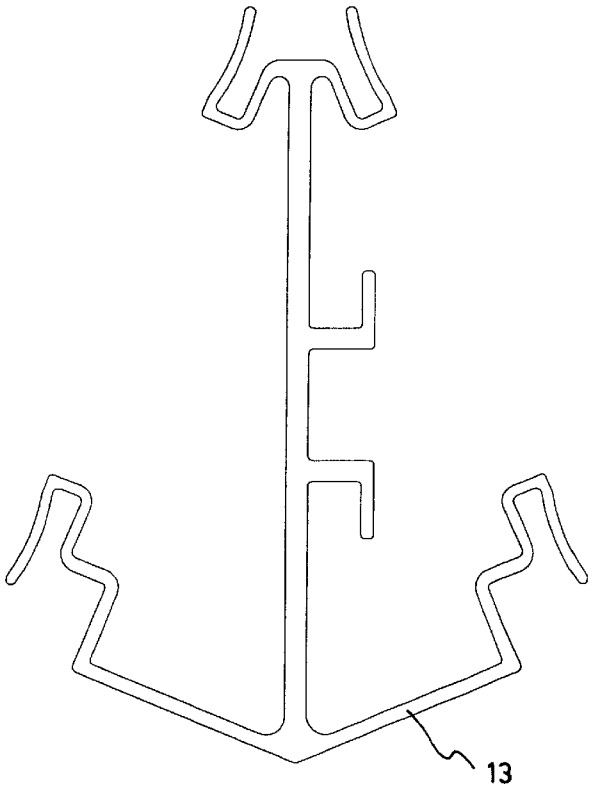
FIG. 50 is a cross-sectional view of a corner post according to a preferred embodiment of the invention.
Figure 51:
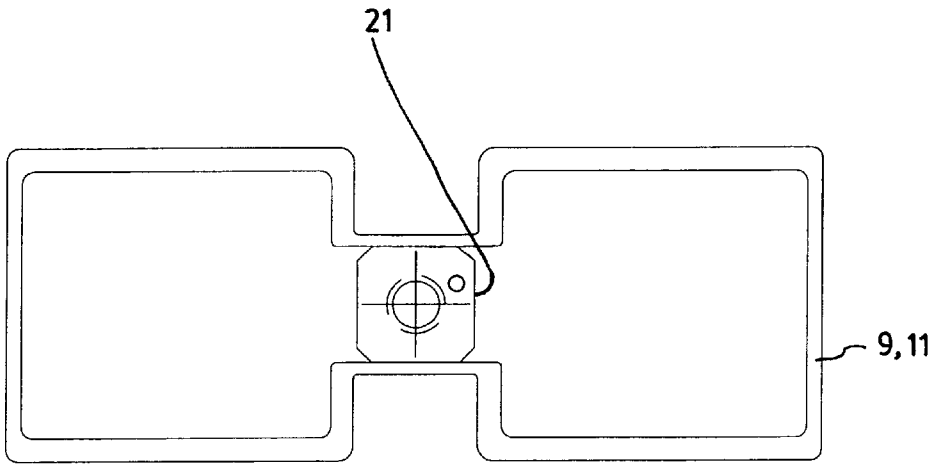
FIG. 51 is a cross-sectional view of a distance channel according to a preferred embodiment of the invention, said distance channel being shown provided with a connecting stud.
Figure 52:
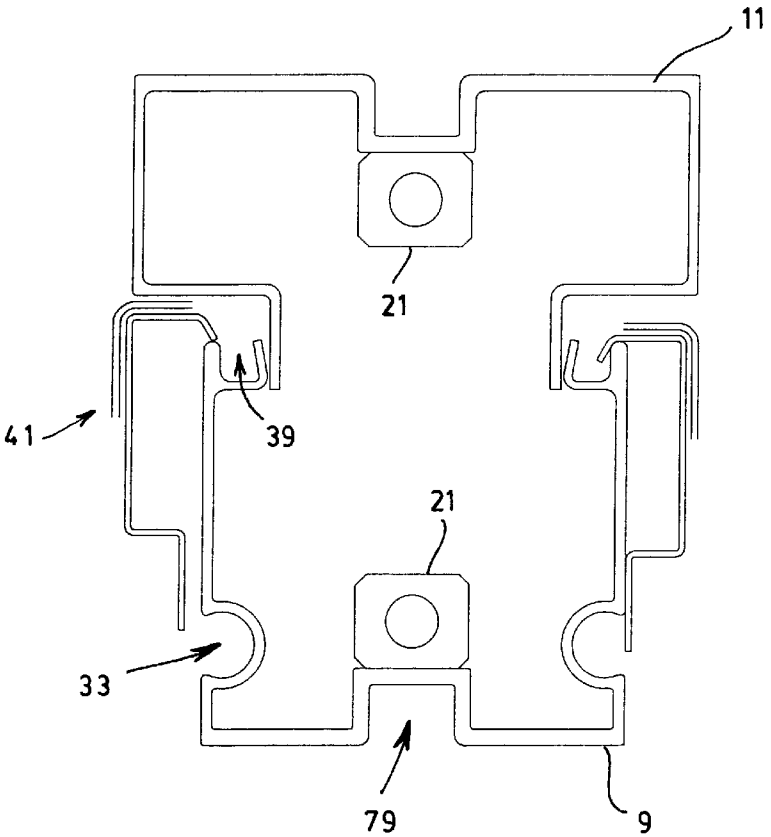
FIG. 52 is a partial cross-sectional view of a wall panel assembly according to a preferred embodiment of the invention.
Figure 53:
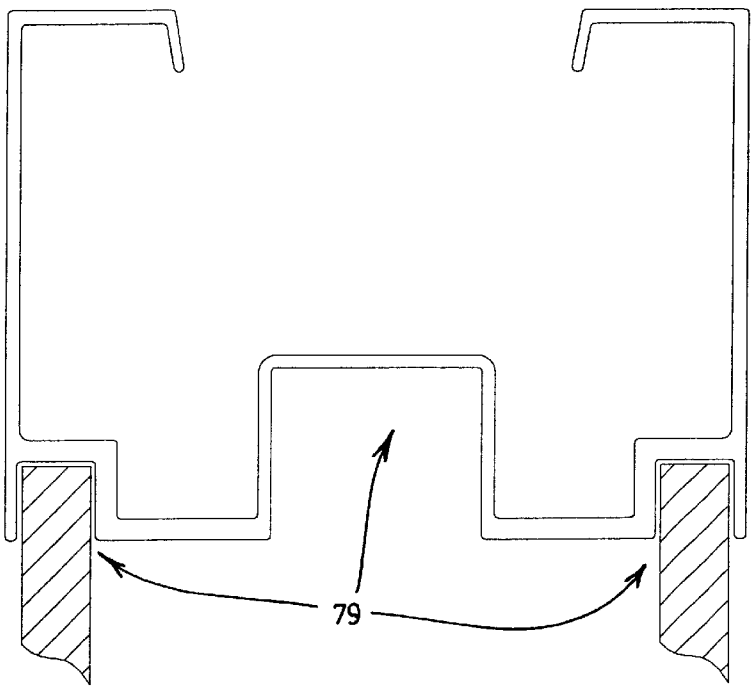
FIG. 53 is a cross-sectional view of a distance channel according to yet another preferred embodiment of the invention.
Figure 54:
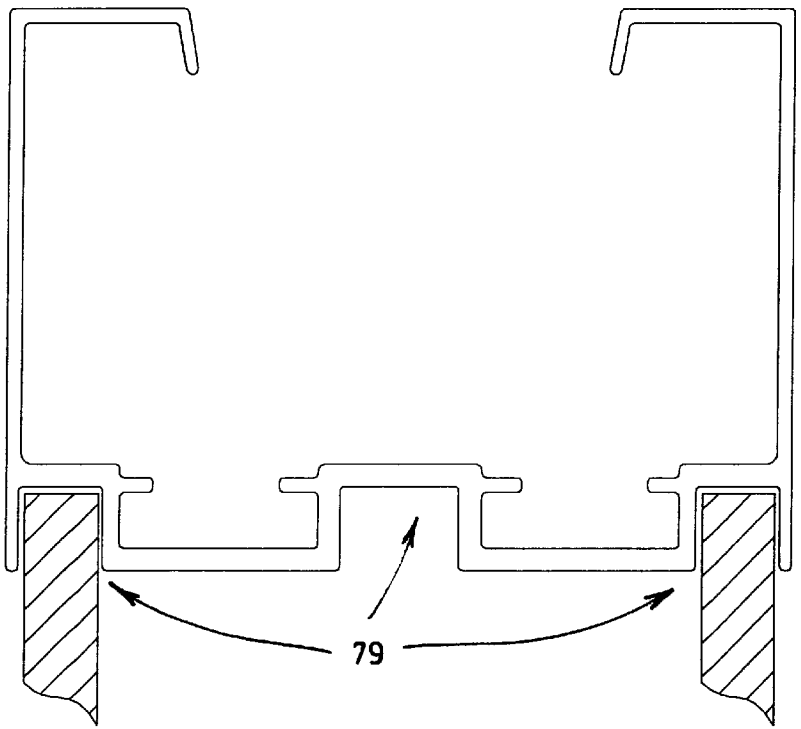
FIG. 54 is a cross-sectional view of a distance channel according to yet another preferred embodiment of the invention.
Figure 55:
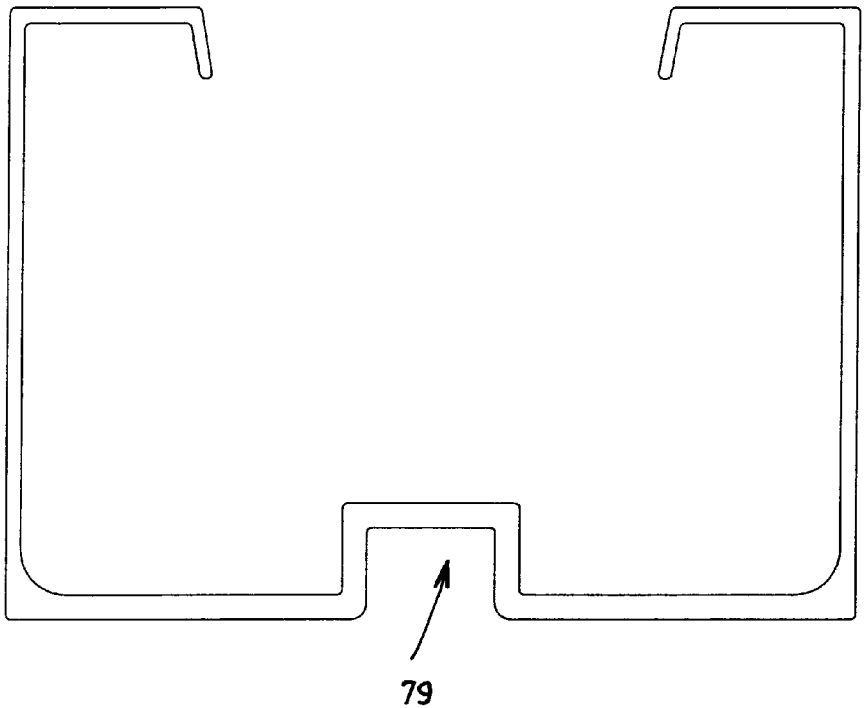
FIG. 55 is a cross-sectional view of a distance channel according to yet another preferred embodiment of the invention.
Figure 56:
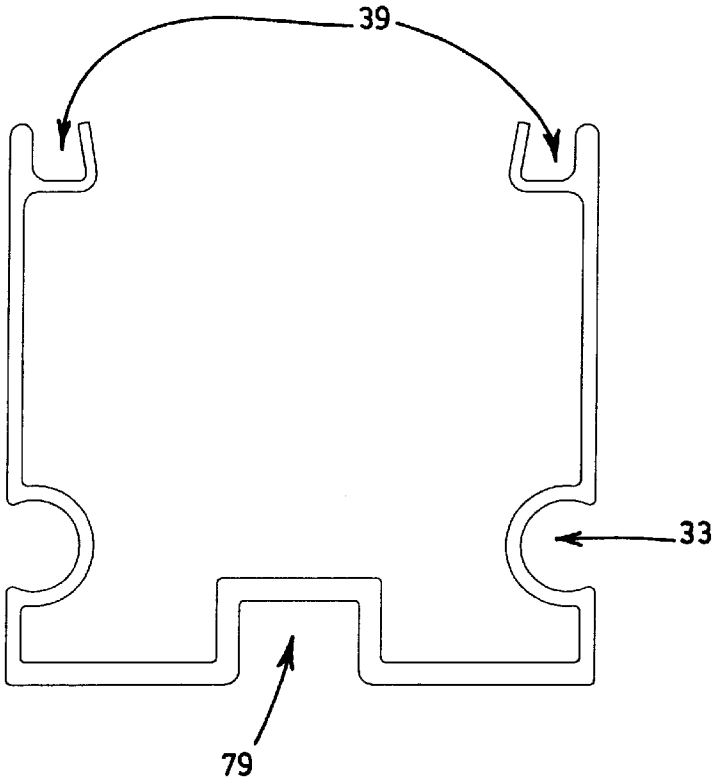
FIG. 56 is a cross-sectional view of a distance channel according to yet another preferred embodiment of the invention.
Figure 57:
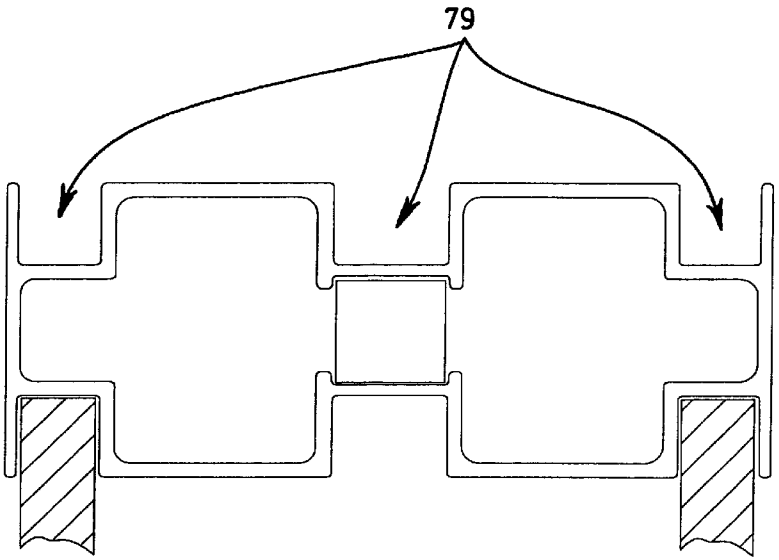
FIG. 57 is a cross-sectional view of a transition channel according to a preferred embodiment of the invention.
Figure 58:
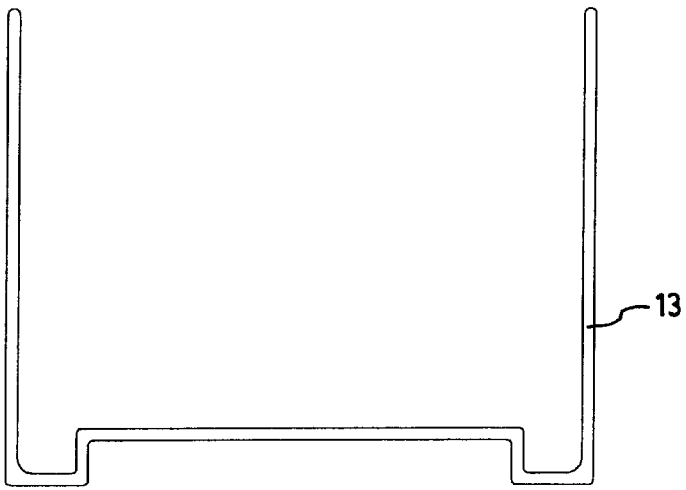
FIG. 58 is a cross-sectional view of a wall post according to a preferred embodiment of the invention.
Figure 59:
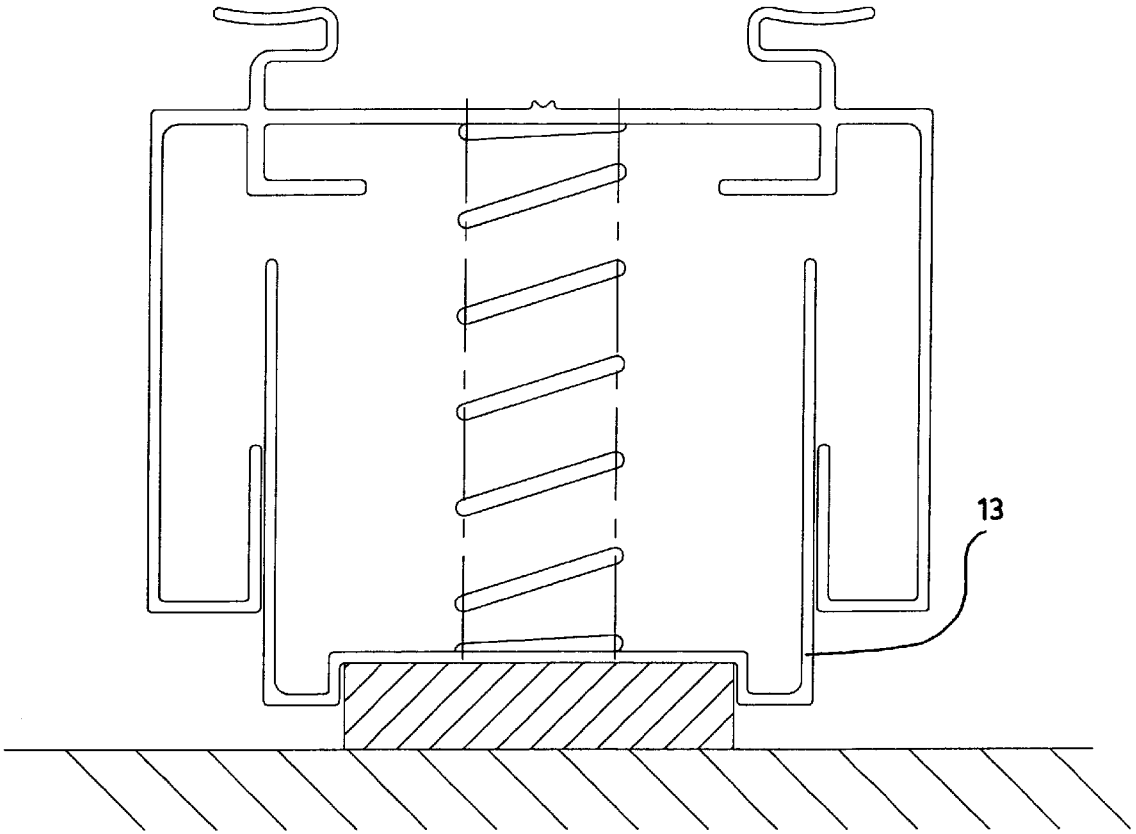
FIG. 59 is a cross-sectional view of a wall panel assembly according to yet another preferred embodiment of the invention.

FIGS. 46 to 59 illustrate different cross-sectional embodiments of the above-discussed various components of the wall panel system 1 according to the present invention. Indeed, FIG. 46 illustrates a glass vertical post 13. FIG. 47 shows a vertical post 13 mounted with a weatherstrip holder 91. FIG. 48 illustrates a solid panel vertical post 13. FIG. 49 illustrates a corner profile building module. FIG. 50 illustrates a 135° corner post 13. FIG. 51 illustrates a glass—glass transition distance channel 9, 11 comprising a connecting stud 21. FIG. 52 illustrates a glass-solid transition distance channel 9, 11. FIG. 53 illustrates a double glaze distance channel 9, 11. FIG. 54 illustrates another double glaze distance channel 9, 11. FIG. 55 illustrates a top-bottom distance channel 9, 11 of a glass panel 3. FIG. 56 illustrates a top-bottom distance channel 9, 11 of a solid panel 3. FIG. 57 illustrates a double glass transition channel 9, 11. FIG. 58 illustrates an inner telescopic channel 9, 11 of a wall post 13. FIG. 59 illustrates the wall post 13 of FIG. 58 cooperating with different components of the panel system 1.

Figure 60:
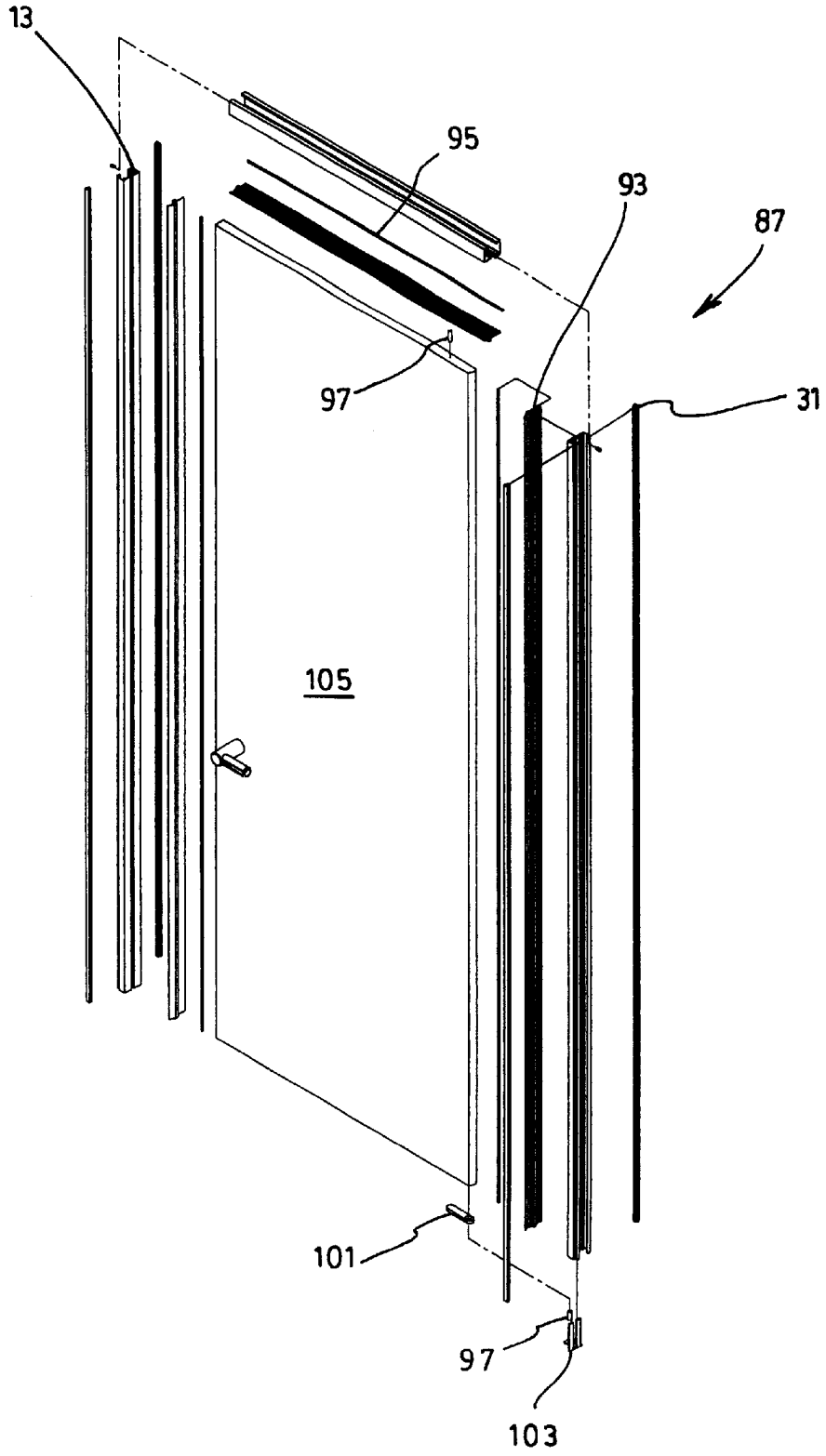
FIG. 60 is an exploded view of a door panel assembly according to a preferred embodiment of the invention.
Figure 61:
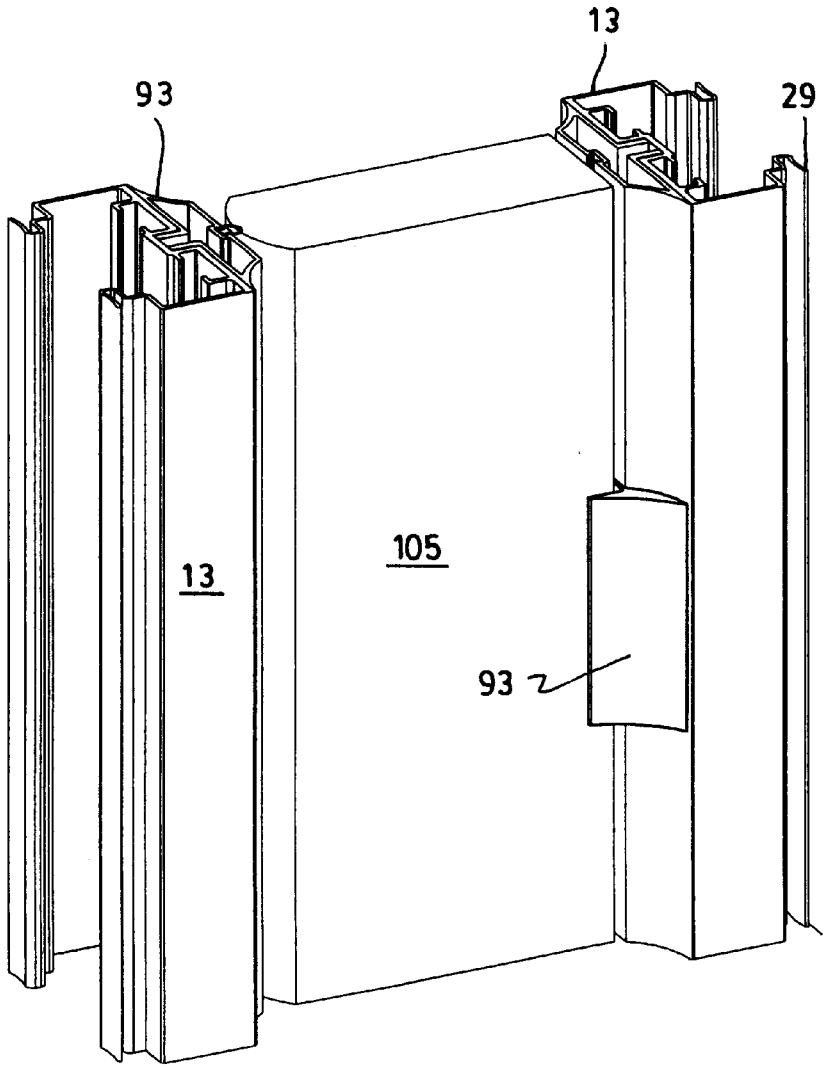
FIG. 61 is a partial sectional perspective view of the door assembly shown in FIG. 60.
Figure 62:
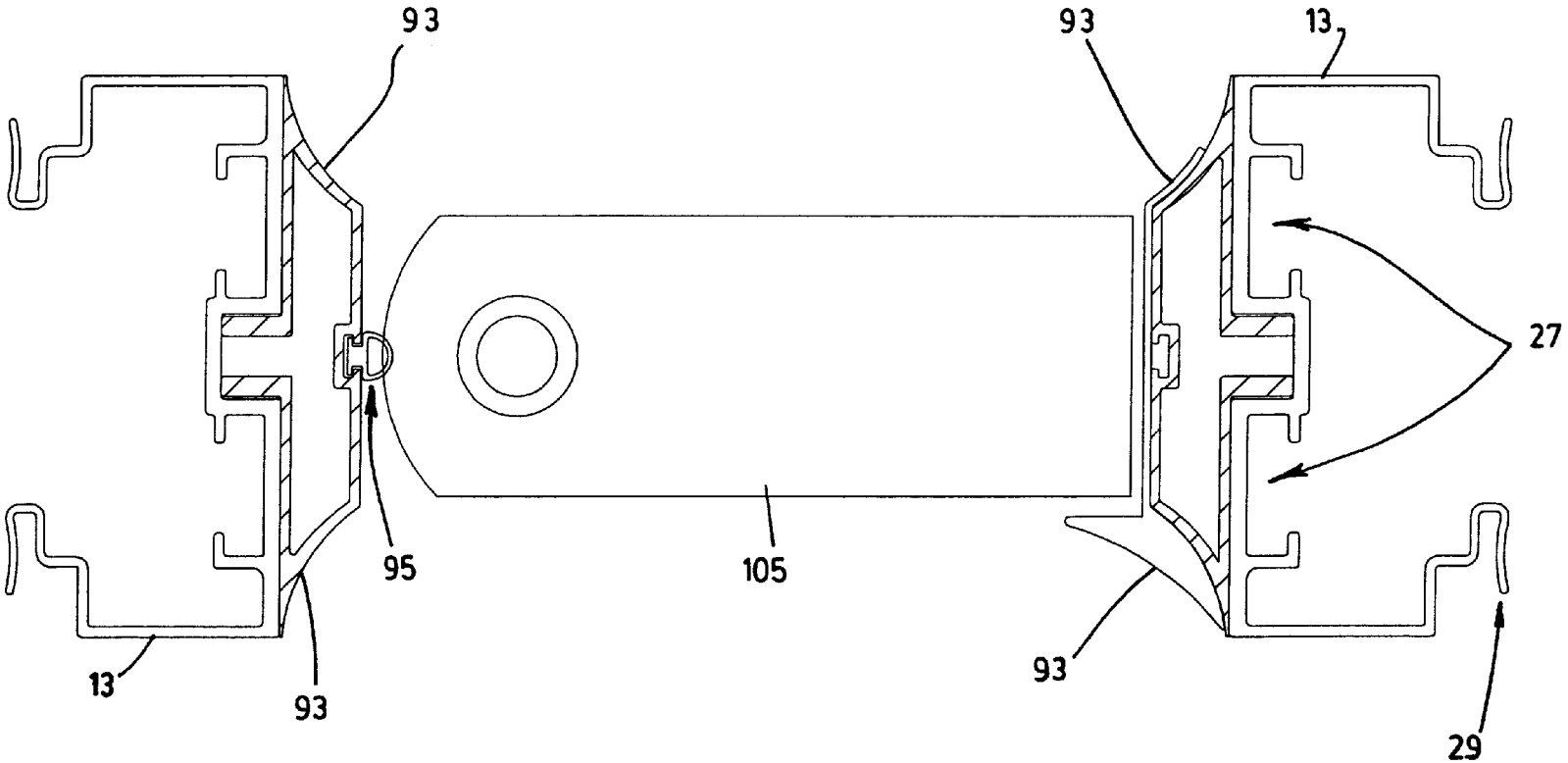
FIG. 62 is a cross-sectional view of the wall assembly shown in FIG. 61.
Figure 63:
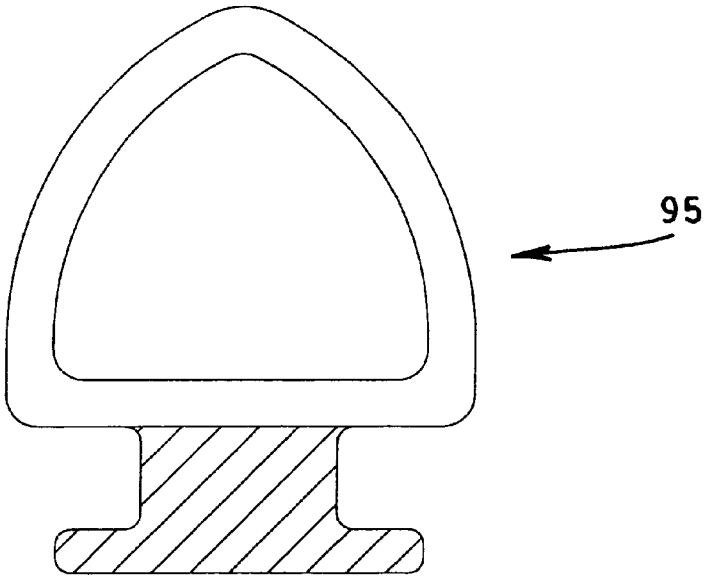
FIG. 63 is a cross-sectional view of the door bumper shown in FIG. 62.

Referring now to FIG. 60, there is shown an exploded view of a door assembly 87 according to a preferred embodiment of the invention. Similarly to the wall panels 3 of the wall panel system 1 according to the present invention as explained hereinabove, the door assembly 87 comprises vertical posts 13 and a top distance channel 9. The door assembly 87 preferably further comprises left and right center strikes 93, suitable bumpers 95, a top door pivot 97, a bottom door pivot 99, a bottom pivot plate 101, and a bottom pivot base 103. As better shown in FIGS. 61 and 62, the center strikes 93 are preferably mounted to the vertical posts 13 by means of projecting members which are removably insertable into the intersepta 79 of the vertical posts 13, as better shown in FIG. 62. The center strikes 93 preferably also each comprise an interseptum 79 onto which may be removably mounted a door bumper 95, such as the one shown in FIG. 63, or other components explained herein and illustrated in the accompanying drawings.

Figure 64:
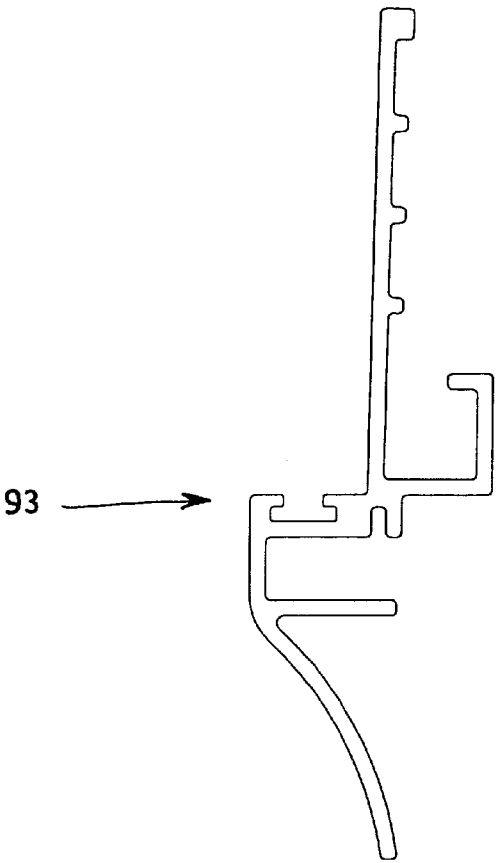
FIG. 64 is a cross-sectional view of the door strike shown in FIG. 62.
Figure 65:
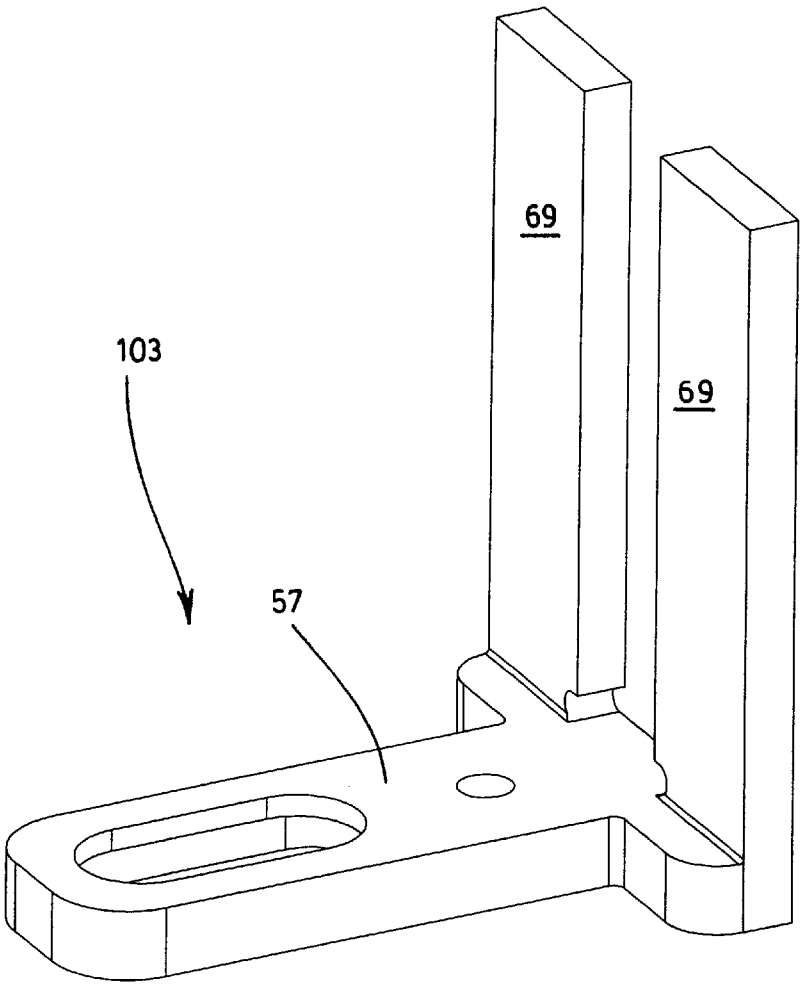
FIG. 65 is a perspective view of the door pivot shown in FIG. 60.

Other suitable door strikes 93 and other embodiments of such, may be used, such as the one shown in FIG. 64. The bottom pivot plate 101 is preferably inserted into a corresponding recessed cavity of the door 105 and is operatively connected by means of the bottom pivot 99 to the bottom pivot plate 101 which, similarly to the glide 53, comprises corresponding tongues 69 which are removably insertable into the receiving channels 33 of the vertical posts 13. As better shown in FIG. 65, the bottom pivot base 103 preferably comprises an abutment flange 57 having a hole into which a suitable fastener is inserted to connect the pivot base 103 onto the ground floor. The abutment flange 57 of the pivot base 103 is operatively connected to the door 105 by means of the bottom pivot 99 and other suitable connecting means, as apparent to a person skilled in the art.

Figure 66:
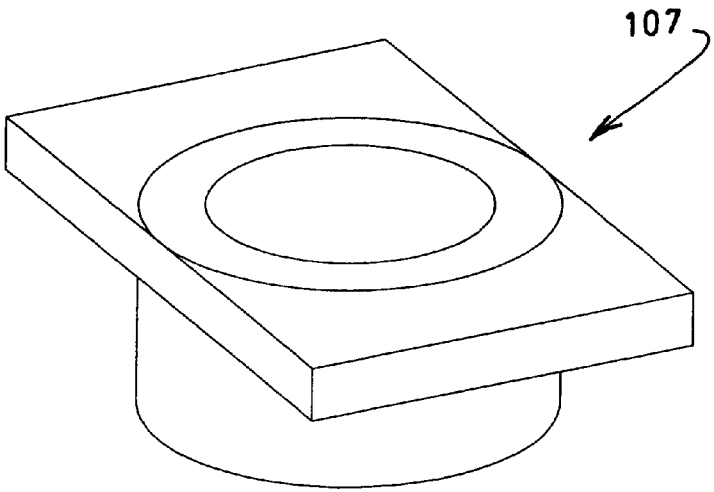
FIG. 66 is a perspective view of the top pivot bushing shown in FIG. 60.

FIG. 66 illustrates a preferred embodiment of the top pivot bushing 107 as used in the door assembly 87 of FIG. 60.

Figure 67:
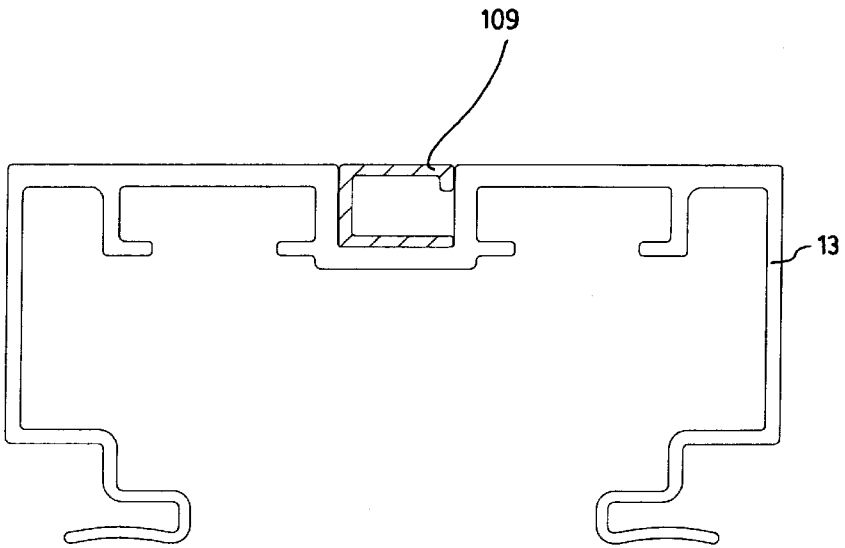
FIG. 67 is a cross-sectional view of a vertical post according to yet another preferred embodiment of the invention, said vertical post being shown with an opening filler strip mounted into the interseptum of the vertical post.

FIG. 67 illustrates an opening filler strip 109 which may be used to close up the interseptum 79 of the vertical post 13 of the door assembly shown in FIG. 60.

Figure 68:
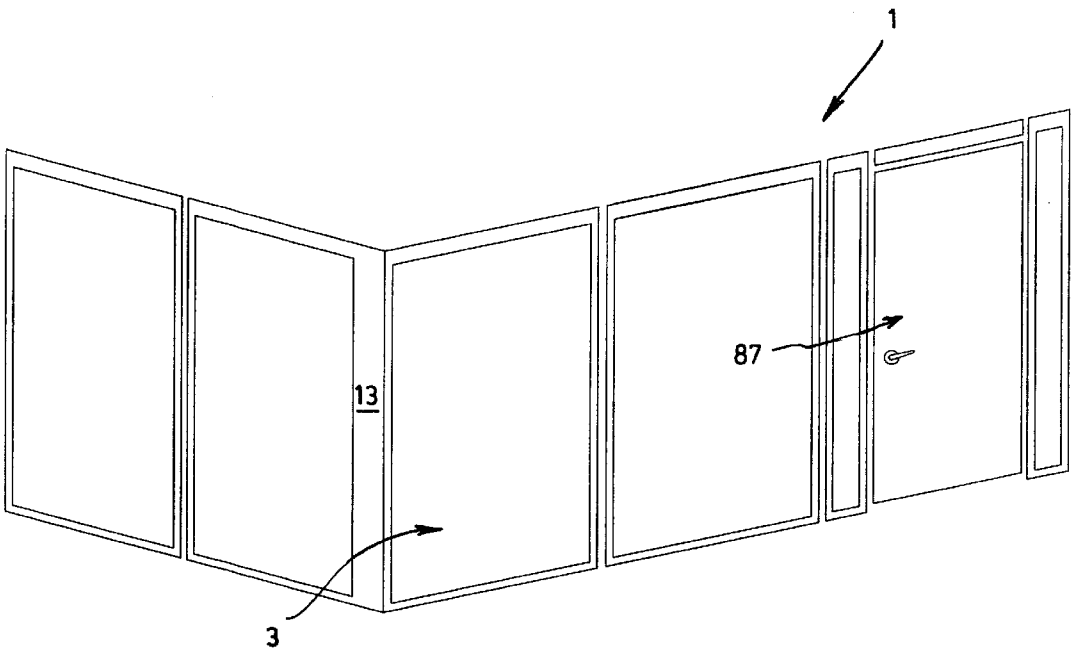
FIG. 68 is a perspective view of an assembled wall panel system according to a preferred embodiment of the invention, said assembled wall panel system being shown with glass panels and a door assembly such as the one of FIG. 60.

FIG. 68 is a perspective view of an assembled wall panel system 1 according to a preferred embodiment of the invention, the assembled wall panel system 1 being shown with glass panels 3 and a door assembly 87.

As may now be appreciated, the wall panel system 1 according to the present invention is an improvement over the prior art in that it provides variable sized, prefabricated panels 3 available in both furniture and building module, ceiling height (either flush or recessed base and ceiling conditions), clear story and/or free standing options. Furthermore, the present invention is an improvement over the prior art in that the wall thickness of a wall panel 3 is preferably 3½" thus allowing for superior sound rating, as well as passthrough components, i.e. electrical wires, communication and network cables, air conditioning, fiber optic cables, and the like. The present invention is also advantageous in that the outer panel shells 35 are removable by means of specially designed connecting strips, i.e. connectors 31. These connecting strips and the shells 35 are designed in such a way as to achieve on sight demountability. Moreover, they allow for field installation of electrical, communication and fiber optic wires. According to the present invention, the wall panel system 1 is also advantageous in that the adjustability at the ceiling is preferably ±1". As explained hereinabove, the present invention is also advantageous in that the panels 3 are stackable onto one another. Indeed, the unique splice connector, i.e. flyover 81, allows panels 3 to be stacked on top of each other, thereby allowing the stacked panels 3 to exceed a preferred 120" in height. Furthermore, the panel wall system 1 according to the present invention is also advantageous in that the panel-to-panel connectors 31 gives both the ability to adjust for "panel creep" and, using the flush version, allows the system 1 to be used in "clean room" and fire-rated corridor environments. As explained hereinabove, the vertical and horizontal shapes of the wall panel system 1 are designed so that it can accommodate both single or double glazing, and a variety of blinds and privacy screens. Furthermore, the unique design of the lower glide assembly 25 allows for an adjustability of over a preferred 3". Moreover, the panels 3 may be attached to drywalls by means of a telescopic wall connector 31, as shown in the accompanying drawings. Furthermore, the specially designed glazing posts 13 allow for electrical and communication wiring to be housed inside these posts 13. Additionally, the outer panel shells 35 according to the present invention may be manufactured from a variety of materials, i.e. steel, wood, gypsum, plastic, fiberglass, etc., in a variety of finishes (fabric, vinyl, veneer, paint, laminates, for example). Furthermore, the wall panel system 1 according to the present invention is also advantageous in that it has the capacity to allow for pocket doors, pivot doors, and hinged doors. Furthermore, according to the present invention, there is a minimal number of "loose" components on the job site which allows for an easy and clean installation. Moreover, as explained hereinabove, the present invention is also advantageous in that it also allows for hanging componentry, i.e. worksurfaces, light accessories, and the like.

Of course, numerous modifications can be made to the above-described embodiments without departing from the scope of the invention as described in the appended claims.

What is claimed is:

1. A moveable and demountable wall panel system comprising a plurality of panels used for defining an office space, each panel having a vertical axis and a horizontal axis, each panel comprising:

opposite top and bottom distance channels, the distance channels extending along directions substantially parallel to the horizontal axis of the panel;

opposite left and right vertical posts, the vertical posts extending along directions substantially parallel to the vertical axis of the panel, the distance channels and vertical posts being affixed to one another by means of connecting studs for forming a rectangular support frame of the panel;

a panel covering removably mountable onto receiving means of the rectangular support frame;

a ceiling rail operatively connected to a top portion of the rectangular support frame, the ceiling rail being used for operatively securing the rectangular support frame of the panel to a ceiling surface; and an articulating floor channel operatively connected to a bottom portion of the rectangular support frame by means of left and right glide assemblies mounted into receiving channels of the left and right vertical posts respectively, the articulating floor channel being used for operatively securing the rectangular support frame of the panel to a ground surface, the glide assemblies being further used for displacing the rectangular support frame with respect to the floor channel along a direction substantially parallel to the vertical axis of the panel;

each vertical post comprising at least one receiving lip extending along a direction substantially parallel to the vertical axis of the panel, each receiving lip being removably connectable to another receiving lip of a vertical post of a neighboring panel by means of a connector for selectively and removably connecting together plurality of panels in order to define said office space; the receiving means comprising receiving grooves disposed along the vertical posts in a direction substantially parallel to the vertical axis of the pane; and the panel covering comprising an outer panel shell and vertical stiffeners, the vertical stiffeners being securely affixed to lateral sides of the outer panel shell of the panel covering and being removably connectable onto the receiving grooves of the vertical posts for removably connecting the panel covering onto the rectangular support frame of the panel.

2. A moveable and demountable wall panel system according to claim 1, wherein the receiving means comprise a receiving groove disposed along the top distance channel in a direction substantially parallel to the horizontal axis of the panel and wherein the panel covering comprises an outer panel shell and a top stiffener, the top stiffener being securely affixed to a lateral side of the outer panel shell of the panel covering and being removably hookable onto the receiving groove of the top distance channel for removably hooking the panel covering onto the rectangular support frame of the panel.

3. A moveable and demountable wall panel system according to claim 2, wherein the vertical stiffeners each comprise a bracket and a flexible clip securely affixed onto one another, the brackets being further securely affixed to the lateral sides of the outer panel shell of the panel covering and the flexible clips being removably connectable into the receiving grooves of the vertical posts.

4. A moveable and demountable wall panel system according to claim 1, wherein the panel covering comprises an outer panel shell and intermediate stiffeners, the intermediate stiffeners being securely affixed transversely onto the outer panel shell of the panel covering in a direction substantially parallel to the horizontal axis of the panel.

5. A moveable and demountable wall panel system according to claim 1, wherein the connectors comprise fins.

6. A moveable and demountable wall panel system according to claim 1, wherein the connectors are provided with covering caps.

7. A moveable and demountable wall panel system according to claim 1, wherein the connectors comprise flexible skirts.

8. A moveable and demountable wall panel system according to claim 1, wherein the floor channel is securely affixed to the ground surface by means of fasteners, and wherein the ceiling rail is securely affixed to the ceiling surface by means of fasteners.

9. A moveable and demountable wall panel system according to claim 1, wherein each glide assembly comprises:

a substantially L-shaped glide, said glide having an abutment flange and an insert, the insert being removably insertable into a receiving channel of a corresponding vertical post; and a glide bolt, said glide bolt being threadedly mounted into the abutment flange of the glide and having a pivot head articulately mounted to the floor channel by means of a rivet.

10. A moveable and demountable wall panel system according to claim 9, wherein the pivot head of the glide bolt is positioned inside a longitudinal groove of the floor channel, and wherein the rivet of the pivot head is constrained to slide along a transversal slot of the longitudinal groove of the floor channel.

11. A moveable and demountable wall panel system according to claim 9, wherein the insert of the glide comprises two tongues removably mountable into respective receiving channels of a corresponding vertical post.

12. A moveable and demountable wall panel system according to claim 1, wherein the wall panel system further comprises a base cover.

13. A moveable and demountable wall panel system according to claim 12, wherein the base cover comprises a base cover insert for mounting the base cover onto the floor channel of the panel.

14. A moveable and demountable wall pane system according to claim 1, wherein at least two connecting studs are respectively and securely affixed at opposite ends of each of the top and bottom distance channels.

15. A moveable and demountable wall panel system according to claim 1, wherein each distance channel and each vertical post comprise at least one interseptum, and wherein accessories of the panel system are removably mounted onto said intersepta.

16. A moveable and demountable wall panel system according to claim 1, wherein each panel is stackable onto another panel by means of stackable flyovers inserted and fastened into the receiving channels of the vertical posts of said stacked panels.

17. A moveable and demountable wall panel system according to claim 16, wherein the stackable flyovers comprise interference ribs.

18. A moveable and demountable wall panel system according to claim 1, wherein the vertical posts comprise punched marks extending longitudinally along said vertical posts, said punched marks being used for hooking accessories onto said vertical posts of the panel system.

19. A moveable and demountable wall panel system according to claim 1, wherein the system further comprises a door assembly.

* * * * *